US010783785B2

(12) United States Patent
Tsuchida et al.

(10) Patent No.: US 10,783,785 B2
(45) Date of Patent: Sep. 22, 2020

(54) TRAIN PRESENCE DETECTION APPARATUS

(71) Applicant: Mitsubishi Electric Corporation, Chiyoda-ku, Tokyo (JP)

(72) Inventors: Katsunori Tsuchida, Tokyo (JP); Tomohiro Onishi, Tokyo (JP); Takaya Katsuragi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/486,959

(22) PCT Filed: Mar. 28, 2018

(86) PCT No.: PCT/JP2018/012935

§ 371 (c)(1),
(2) Date: Aug. 19, 2019

(87) PCT Pub. No.: WO2018/181553

PCT Pub. Date: Oct. 4, 2018

(65) Prior Publication Data

US 2020/0013286 A1 Jan. 9, 2020

(30) Foreign Application Priority Data

Mar. 31, 2017 (JP) ..... 2017-070018

(51) Int. Cl.
*G08G 1/01* (2006.01)
*G08G 1/127* (2006.01)
(Continued)

(52) U.S. Cl.
CPC ..... *G08G 1/127* (2013.01); *B61L 21/06* (2013.01); *B61L 25/025* (2013.01); *B61L 27/0005* (2013.01)

(58) Field of Classification Search
CPC ..... G08G 1/127; B61L 23/14; B61L 27/0077; B61L 27/0038; B61L 29/00; B61L 3/16;
(Continued)

(56) References Cited

U.S. PATENT DOCUMENTS 8,939,412 B2 * 1/2015 Tokumaru ..... B61L 25/025 246/122 R
8,965,604 B2 * 2/2015 Nandedkar ..... B61L 3/008 701/19
(Continued)

FOREIGN PATENT DOCUMENTS

JP 2003306146 A 10/2003

OTHER PUBLICATIONS

International Search Report (PCT/ISA/210) and Written Opinion (PCT/ISA/237) dated Jul. 3, 2018, by the Japan Patent Office as the International Searching Authority for International Application No. PCT/JP2018/012935.

*Primary Examiner* — Toan N Pham
(74) *Attorney, Agent, or Firm* — Buchanan Ingersoll & Rooney PC

(57) ABSTRACT

A train presence detection apparatus includes an information acquisition unit to acquire position information on a first end point and a second end point located in a first line section formed in a loop and virtual block presence/absence information indicating whether a virtual block indicating a specific position in the first line section is included in a designated section that is any of a first section and a second section in which the first end point and the second end point are located at both ends; a designated section determination unit to determine which of the first section and the second section is the designated section based on the position information on the first end point and the second end point and the virtual block presence/absence information; and a
(Continued)

presence determination unit to determine whether a train is present in the designated section.

19 Claims, 15 Drawing Sheets

(51) Int. Cl.
*B61L 21/06* (2006.01)
*B61L 25/02* (2006.01)
*B61L 27/00* (2006.01)

(58) Field of Classification Search
CPC ..... B61L 25/025; B61L 25/02; B61L 27/005; B61L 23/16; B61L 3/12; B61L 21/06
See application file for complete search history.

(56) References Cited

U.S. PATENT DOCUMENTS 10,507,853 B2 * 12/2019 Kaede ..... B61L 15/0027
2017/0313331 A1 * 11/2017 Hilleary ..... B61L 17/02

* cited by examiner

FIG.4

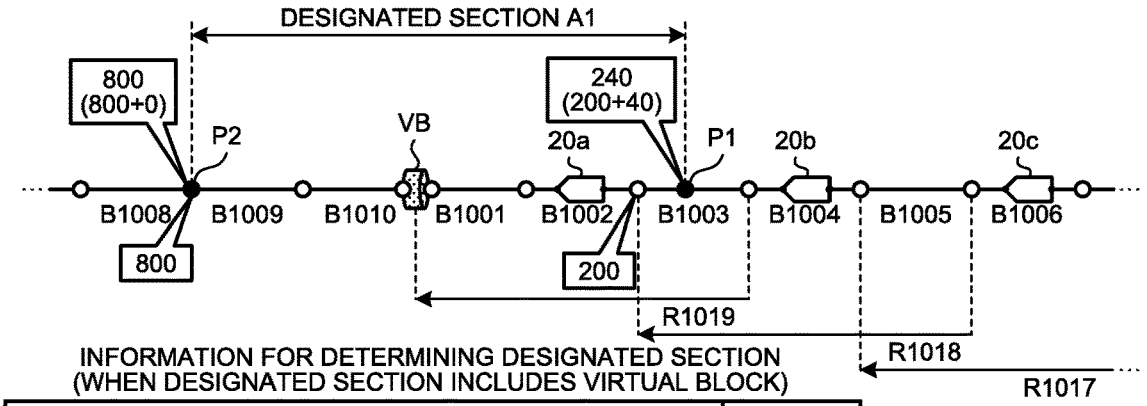

INFORMATION FOR DETERMINING DESIGNATED SECTION
(WHEN DESIGNATED SECTION INCLUDES VIRTUAL BLOCK)

| INFORMATION ACQUIRED BY INFORMATION ACQUISITION UNIT | DATA |
|---|---|
| POSITION INFORMATION ON FIRST END POINT P1 | 240 |
| POSITION INFORMATION ON SECOND END POINT P2 | 800 |
| VIRTUAL BLOCK PRESENCE/ABSENCE INFORMATION | INCLUDED |

FIG.5

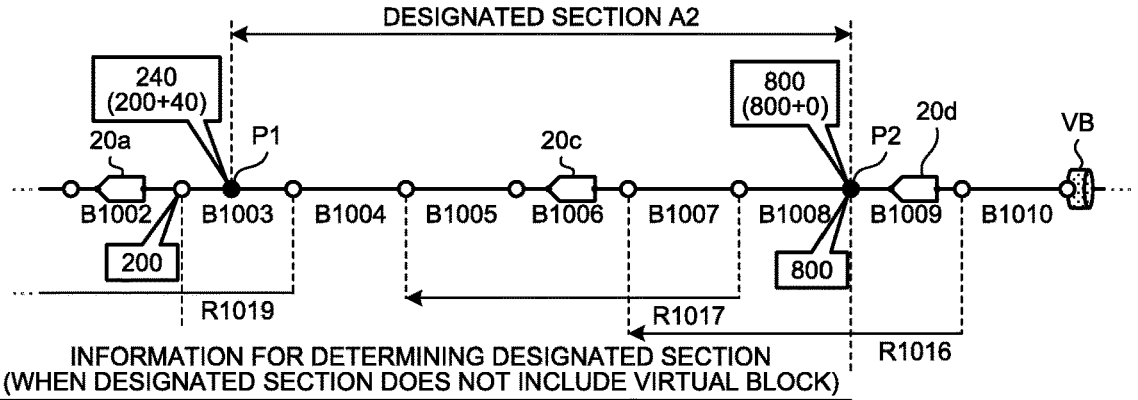

INFORMATION FOR DETERMINING DESIGNATED SECTION
(WHEN DESIGNATED SECTION DOES NOT INCLUDE VIRTUAL BLOCK)

| INFORMATION ACQUIRED BY INFORMATION ACQUISITION UNIT | DATA |
|---|---|
| POSITION INFORMATION ON FIRST END POINT P1 | 240 |
| POSITION INFORMATION ON SECOND END POINT P2 | 800 |
| VIRTUAL BLOCK PRESENCE/ABSENCE INFORMATION | NOT INCLUDED |

FIG.6

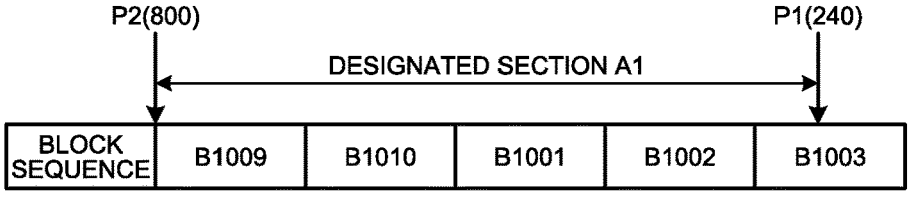

| SENSOR ID | XXXX | YYYY | ZZZZ |
|---|---|---|---|
| POSITION INFORMATION ON FIRST END POINT P1 | 240 | ··· | ··· |
| POSITION INFORMATION ON SECOND END POINT P2 | 800 | ··· | ··· |
| VIRTUAL BLOCK PRESENCE/ABSENCE INFORMATION | INCLUDED | ··· | ··· |

FIG.18

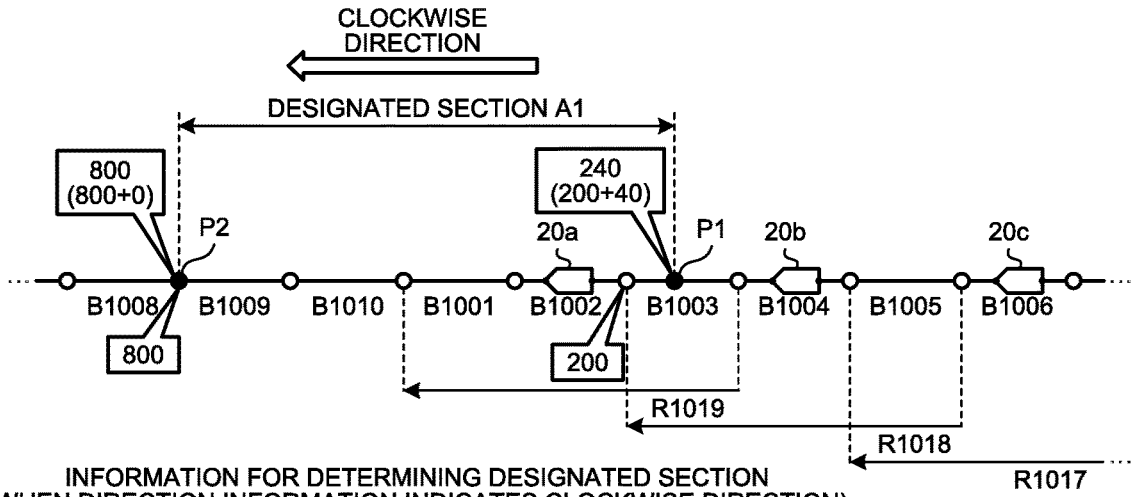

INFORMATION FOR DETERMINING DESIGNATED SECTION
(WHEN DIRECTION INFORMATION INDICATES CLOCKWISE DIRECTION)

| INFORMATION ACQUIRED BY INFORMATION ACQUISITION UNIT | DATA |
|---|---|
| POSITION INFORMATION ON FIRST END POINT P1 | 240 |
| POSITION INFORMATION ON SECOND END POINT P2 | 800 |
| DIRECTION INFORMATION | CLOCKWISE DIRECTION |

FIG.19

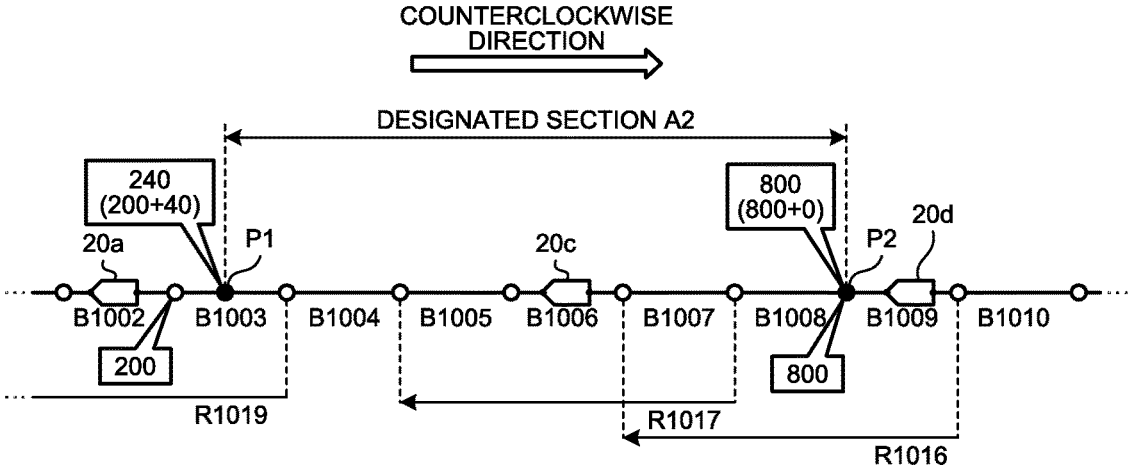

INFORMATION FOR DETERMINING DESIGNATED SECTION
(WHEN DIRECTION INFORMATION INDICATES COUNTERCLOCKWISE DIRECTION)

| INFORMATION ACQUIRED BY INFORMATION ACQUISITION UNIT | DATA |
|---|---|
| POSITION INFORMATION ON FIRST END POINT P1 | 240 |
| POSITION INFORMATION ON SECOND END POINT P2 | 800 |
| DIRECTION INFORMATION | COUNTERCLOCKWISE DIRECTION |

| SENSOR ID | XXXX | YYYY | ZZZZ |
|---|---|---|---|
| POSITION INFORMATION ON FIRST END POINT P1 | 240 | ... | ... |
| POSITION INFORMATION ON SECOND END POINT P2 | 800 | ... | ... |
| DIRECTION INFORMATION | CLOCKWISE DIRECTION | ... | ... |

TRAIN PRESENCE DETECTION APPARATUS

FIELD

The present invention relates to a train presence detection apparatus that determines whether a train is present in a designated section.

BACKGROUND

There is known a conventional technique for detecting whether a train is present in a specific section. In order to detect the presence of a train, it is necessary to specify a position where the train is present. As a technique for specifying a position where a train is present, there is disclosed a train that includes a train position specifying unit that specifies an absolute position of the train using wireless communication. (See, for example, Patent Literature 1).

CITATION LIST

Patent Literature

Patent Literature 1: Japanese Patent Application Laid-open No. 2003-306146

SUMMARY

Technical Problem

In a line section formed in a loop, however, when a section is designated by two different end points, two designated sections are assumed. Consequently, even when an absolute position of a train is determined as in Patent Literature 1, it is impossible to determine whether the train is present in the designated section, which is a problem.

The present invention has been made to solve the above-described problem, and an object thereof is to provide a train presence detection apparatus capable of determining whether a train is present in a designated section designated in a line section formed in a loop.

Solution to Problem

In order to achieve the above object, a train presence detection apparatus according to an aspect of the present invention includes: an information acquisition unit to acquire position information on a first end point and a second end point located in a first line section formed in a loop and virtual block presence/absence information indicative of whether a virtual block indicating a specific position in the first line section is included in a designated section that is any of a first section and a second section in which the first end point and the second end point are located at both ends; a designated section determination unit to determine which of the first section and the second section is the designated section on a basis of the position information on the first end point and the second end point and the virtual block presence/absence information acquired by the information acquisition unit; and a presence determination unit to determine whether a train is present in the designated section determined by the designated section determination unit.

Advantageous Effects of Invention

The train presence detection apparatus according to an aspect of the present invention includes: an information acquisition unit to acquire position information on a first end point and a second end point located in a first line section formed in a loop and virtual block presence/absence information indicative of whether a virtual block indicating a specific position in the first line section is included in a designated section that is any of a first section and a second section in which the first end point and the second end point are located at both ends; a designated section determination unit to determine which of the first section and the second section is the designated section on a basis of the position information on the first end point and the second end point and the virtual block presence/absence information acquired by the information acquisition unit; and a presence determination unit to determine whether a train is present in the designated section determined by the designated section determination unit. Consequently, it is possible to determine the designated section designated in the first line section formed in a loop and to determine whether a train is present in the designated section.

BRIEF DESCRIPTION OF DRAWINGS

FIG. 4 is a diagram illustrating an example of a case where the side that includes the virtual block is a designated section.

FIG. 5 is a diagram illustrating an example of a case where the side that does not include the virtual block is a designated section.

FIG. 6 is a diagram illustrating an example of a block sequence of the designated section illustrated in FIG. 4.

FIG. 18 is a diagram illustrating an example of a case where the designated section is located in a clockwise direction from the first end point to the second end point.

FIG. 19 is a diagram illustrating an example of a case where the designated section is located in a counterclockwise direction from the first end point to the second end point.

DESCRIPTION OF EMBODIMENTS

Hereinafter, embodiments of a train presence detection apparatus according to the present invention will be described with reference to the drawings.

First Embodiment

Figure 1:
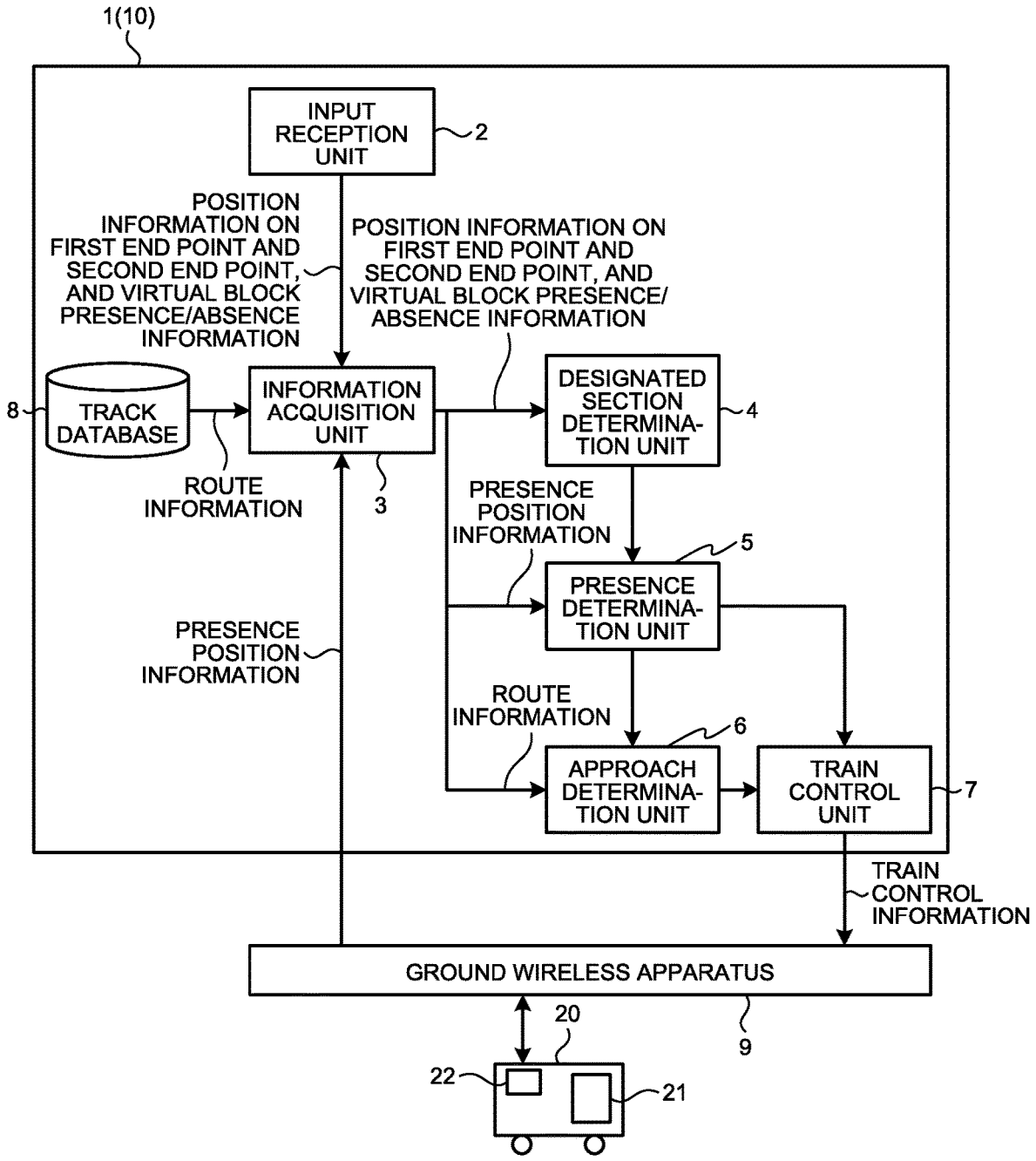
FIG. 1 is a block diagram illustrating an example of a configuration of a train presence detection apparatus according to a first embodiment of the present invention.

FIG. 1 is a block diagram illustrating an example of a configuration of a train presence detection apparatus 1 according to a first embodiment. As illustrated in FIG. 1, the train presence detection apparatus 1 includes an input reception unit 2 that receives input of information; an information acquisition unit 3 that acquires various types of information; a designated section determination unit 4 that determines, on the basis of the information acquired by the information acquisition unit 3, a designated section designated in a loop line section L1 that is a first line section formed in a loop; a presence determination unit 5 that determines whether a train 20 is present in the designated section determined by the designated section determination unit 4; an approach determination unit 6 that determines whether the train 20 is approaching the designated section; a train control unit 7 that generates train control information for controlling the train 20 traveling in the loop line section L1; and a track database 8 that stores route information that is information on a route on which the train 20 travels. In the present embodiment, an example will be described in which the train presence detection apparatus 1 is configured from a ground apparatus 10 that performs wireless communication with the train 20 via a ground wireless apparatus 9. However, the train presence detection apparatus 1 of the present invention is not limited thereto, and may be configured to include an on-board apparatus 21 included in the train 20 as described later or the ground apparatus 10 and the on-board apparatus 21.

The input reception unit 2 is used for receiving information input by an operator, for example. The input reception unit 2 includes, for example, a mouse, a keyboard, and a touch panel, and the operator inputs various types of information, operation commands, and the like. In order to designate a designated section in the loop line section L1, the input reception unit 2 receives input of position information on a first end point P1 and a second end point P2 located at both ends of the designated section and virtual block presence/absence information that indicates whether a virtual block VB indicating a specific position in the loop line section L1 is included in the designated section. The input reception unit 2 outputs, to the information acquisition unit 3, the received position information on the first end point P1 and the second end point P2 and the received virtual block presence/absence information. The designated section is, for example, a temporary speed limit section that is a section in which the train 20 needs to be decelerated to a temporary speed limit or a train protection section that is a section in which entry of the train 20 needs to be prohibited.

Figure 2:
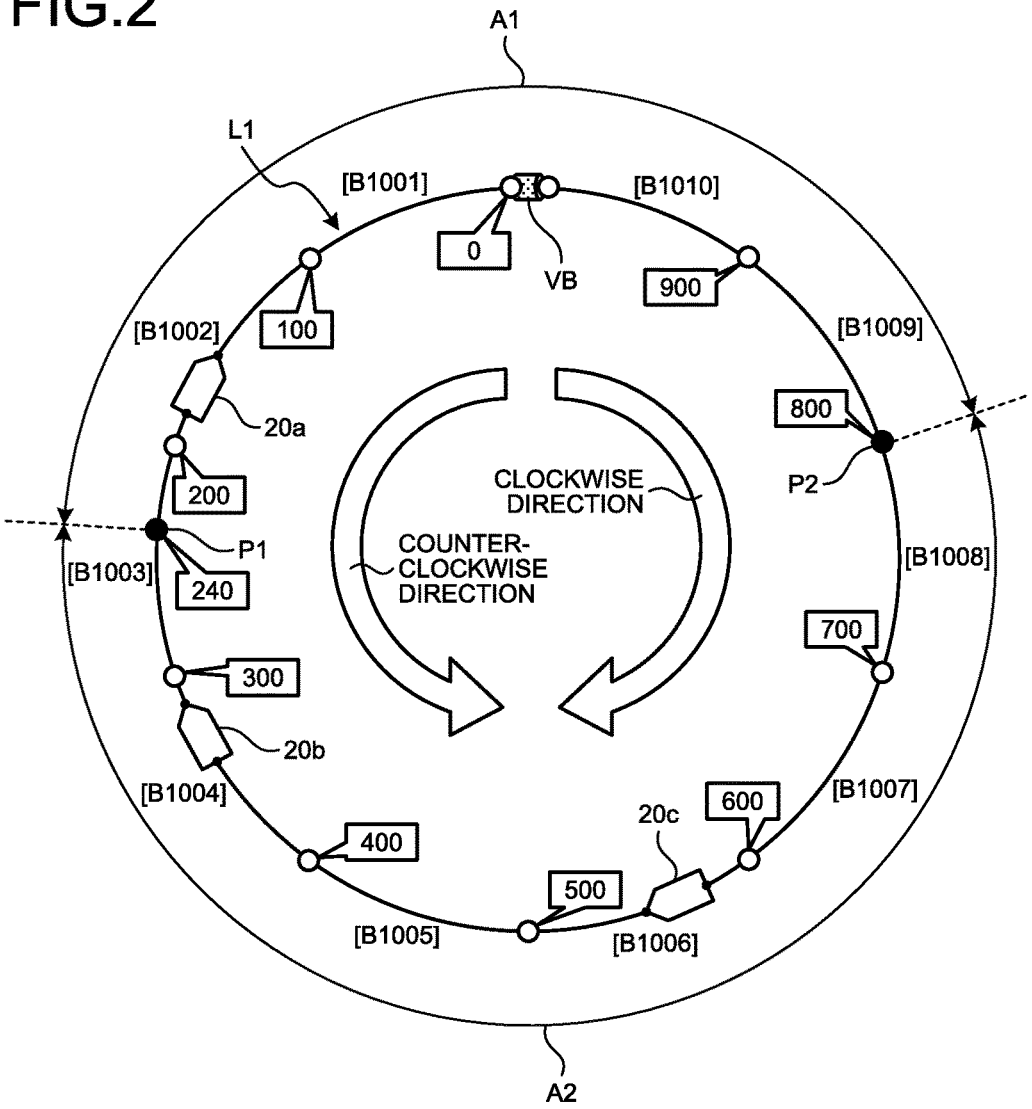
FIG. 2 is a diagram illustrating examples of blocks and a virtual block set in a first line section formed in a loop.
Figure 3:
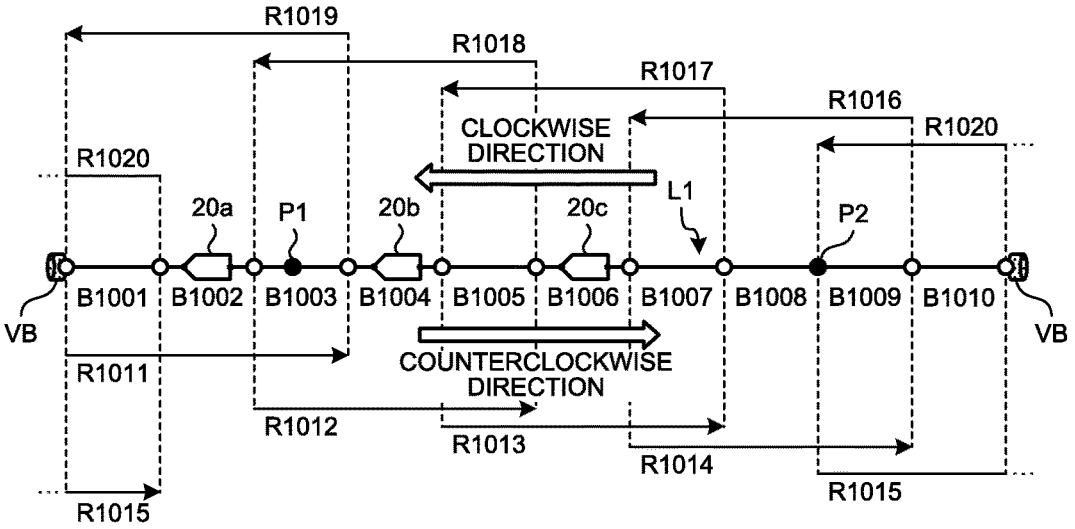
FIG. 3 is a diagram illustrating a state in which the first line section formed in a loop illustrated in FIG. 2 is one-dimensionally expressed.

FIG. 2 is a diagram illustrating examples of blocks and a virtual block set in the first line section formed in a loop. FIG. 3 is a diagram illustrating a state in which the first line section formed in a loop illustrated in FIG. 2 is one-dimensionally expressed. FIG. 4 is a diagram illustrating an example of a case where the side that includes the virtual block is a designated section. FIGS. 2 and 3 illustrate a virtual block VB and multiple divided blocks [B1001] to [B1010] that are set in the loop line section L1. Information on such blocks [B1001] to [B1010] and the virtual block VB is stored, for example, in the track database 8. In FIG. 2, numerals in balloons attached to reference points of the blocks [B1001] to [B1010] on the loop line section L1 indicate kilometrage at the reference points of the blocks [B1001] to [B1010]. The position information on the first end point P1 and the second end point P2 is expressed, for example, by a block number and an intra-block position. For example, as illustrated in FIG. 4, the position information (kilometrage) on the first end point P1 is expressed as 240 obtained by adding 40 that is a coordinate value at the intra-block position in the block [B1003] to 200 that is kilometrage (coordinate value) at a reference point of the block [B1003]. The position information (kilometrage) on the second end point P2 is expressed as 800 obtained by adding 0 that is a coordinate value at the intra-block position in the block [B1009] to 800 that is a coordinate value at a reference point of the block [B1009]. FIG. 2 illustrates an example in which a coordinate value is set such that it decreases when the train 20 travels in a clockwise direction and increases when the train 20 travels in a counterclockwise direction. Since all the blocks [B1001] to [B1010] have a length of "100" in FIG. 2, the block [B1001] has a coordinate value of 0 to 100, the block [B1002] has a coordinate value of 100 to 200, the block [B1003] has a coordinate value of 200 to 300, the block [B1004] has a coordinate value of 300 to 400, the block [B1005] has a coordinate value of 400 to 500, the block [B1006] has a coordinate value of 500 to 600, the block [B1007] has a coordinate value of 600 to 700, the block [B1008] has a coordinate value of 700 to 800, the block [B1009] has a coordinate value of 800 to 900, and the block [B1010] has a coordinate value of 900 to 0 in the illustrated example. The coordinate of a terminating end of each block and the coordinate of a starting end of a block adjacent thereto indicate the same position. The way of setting blocks is not limited to the above. Although a coordinate value is set such that it decreases when the train 20 travels in the clockwise direction and increases when the train 20 travels in the counterclockwise direction in FIG. 2, there is no limitation thereto. The coordinate value may be set such that it increases when the train 20 travels in the clockwise direction and decreases when the train 20 travels in the counterclockwise direction.

The virtual block VB is a point that indicates a specific position in the loop line section L1. The virtual block VB indicates, for example, a predetermined fixed position in the loop line section L1, and in the present embodiment, as illustrated in FIG. 2, the virtual block VB is set at a position of a kilometrage of 0, which is a connection point between a start point and an end point of the loop line section L1. The position where the virtual block VB is set is not limited to the connection point between the start point and the end point of the loop line section L1, and the virtual block VB may be set at any position in the loop line section L1 as long as position information is known in advance. In addition, the position information on the first end point P1 and the second end point P2 is not designated as a coordinate value of the virtual block VB. That is, the first end point P1, the second end point P2, and the virtual block VB are all set to have different coordinate values. When it is desired to designate either the first end point P1 or the second end point P2 as the coordinate value of the virtual block VB, the position information on the first end point P1 or the second end point P2 may be designated such that the virtual block VB is included in the designated section with allowance. The virtual block presence/absence information is information that indicates whether a virtual block is included in a designated section that is any of a first section A1 and a second section A2 illustrated in FIG. 2 in which the first end point P1 and the second end point P2 are located at both ends.

As illustrated in FIG. 1, the information acquisition unit 3 acquires the position information on the first end point P1 and the second end point P2 and the virtual block presence/absence information that are input information received by the input reception unit 2. The information acquisition unit 3 outputs the position information on the first end point P1 and the second end point P2 and the virtual block presence/absence information thus acquired to the designated section determination unit 4. In addition, the information acquisition unit 3 acquires, from the track database 8, route information that indicates a route on which the train 20 travels. The information acquisition unit 3 outputs, for example, the acquired route information to the approach determination unit 6. The route information includes information on a traveling section of the train 20 and information on a traveling direction (clockwise or counterclockwise direction) of the train 20, and is expressed, for example, by a block number. A route R1011, which is an example of the route information illustrated in FIG. 3, represents route information in accordance with which the train 20 travels the blocks [B1001], [B1002], and [B1003] in this order (counterclockwise direction). Although the present embodiment indicates an example in which the track database 8 is provided in the ground apparatus 10, the track database 8 may be provided outside the ground apparatus 10. In addition, the information acquisition unit 3 acquires presence position information on the train 20 from the train 20 via an on-board wireless apparatus 22 and the ground wireless apparatus 9. The information acquisition unit 3 outputs the acquired presence position information on the train 20 to the presence determination unit 5. Although only one train 20 is illustrated in FIG. 1, actually, there are a plurality of trains 20 that travel in the loop line section L1, and the information acquisition unit 3 acquires the presence position information from each train 20 as well as a train ID for identifying each train 20. Although the present embodiment indicates the example in which the information acquisition unit 3 acquires information from the train 20 via the ground wireless apparatus 9, there is no limitation thereto, and the information acquisition unit 3 may be configured to acquire information via a wired connection.

Figure 7:
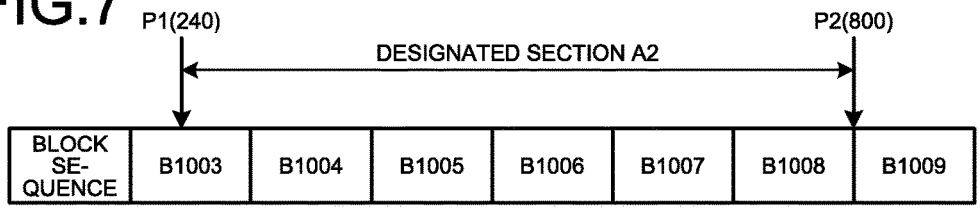
FIG. 7 is a diagram illustrating an example of a block sequence of the designated section illustrated in FIG. 5.

The designated section determination unit 4 determines which of the first section A1 and the second section A2 is the designated section on the basis of the position information on the first end point P1 and the second end point P2 and the virtual block presence/absence information acquired by the information acquisition unit 3. Only with the position information on the first end point P1 and the second end point P2 indicating the positions of both ends of the designated section, it is impossible to determine which of the first section A1 and the second section A2 is the designated section as illustrated in FIG. 2. Therefore, the virtual block presence/absence information that is information indicating whether the virtual block VB is included in the designated section is used in the train presence detection apparatus 1 according to the present invention. Thus, when information indicating that the designated section includes the virtual block VB is acquired as the virtual block presence/absence information, for example, the designated section determination unit 4 determines, as illustrated in FIG. 4, that the first section A1 that is the side that includes the virtual block VB is the designated section. FIG. 5 is a diagram illustrating an example of a case where the side that does not include the virtual block is the designated section. When information indicating that the designated section does not include the virtual block VB is acquired as the virtual block presence/absence information, the designated section determination unit 4 determines, as illustrated in FIG. 5, that the second section A2 that is the side that does not include the virtual block VB is the designated section. FIG. 6 is a diagram illustrating an example of a block sequence of the designated section illustrated in FIG. 4. FIG. 7 is a diagram illustrating an example of a block sequence of the designated section illustrated in FIG. 5. When the designated section is determined, the designated section determination unit 4 generates a block sequence of a section (designated section) between two points that are the first end point P1 and the second end point P2, as illustrated in each of FIGS. 6 and 7.

The presence determination unit 5 determines whether the train 20 traveling in the loop line section L1 is present in the designated section determined by the designated section determination unit 4. The presence determination unit 5 determines whether the train 20 is present in the designated section on the basis of the presence position information on the train 20 acquired by the information acquisition unit 3 and the information on the designated section determined by the designated section determination unit 4.

The presence position information is information on the position of the train 20 in the loop line section L1, and is expressed, for example, by a block number and an intra-block position similarly to the position information on the first end point P1 and the second end point P2. Although not illustrated in detail, for example, when the train 20 passes a ground coil installed at a starting end of each of the blocks [B1001] to [B1010] set in the loop line section L1, a pickup coil in the train 20 detects ground coil information. The ground coil information is received as pickup coil information in the on-board apparatus 21 included in the train 20. The on-board apparatus 21 detects the position of the ground coil by the pickup coil information, uses an absolute position of the ground coil as a reference position, and calculates a travel distance from the reference position, for example, on the basis of speed information detected by a rate generator attached to an axle, thereby obtaining an intra-block position that is a position of the train 20 in a block. Thus, the on-board apparatus 21 can obtain the presence position information on the train 20 to which the on-board apparatus 21 belongs. The ground coil is not limited to being installed at the starting end of each of the blocks [B1001] to [B1010]. There may be cases where the ground coil is installed at a fixed-distance interval, where one ground coil is installed every multiple blocks, or where the ground coil is installed at a position other than the starting end of each of the blocks. The method for obtaining the presence position information on the train 20 is not limited to the above, and a conventionally known method can be used.

The on-board apparatus 21 adds the presence position information on the train 20 and the information on the traveling direction of the train 20 to information on a train ID for identifying the train 20 to which the on-board apparatus 21 belongs, for example, and outputs the above pieces of information to the on-board wireless apparatus 22. The on-board wireless apparatus 22 transmits information including the presence position information on the train 20 received from the on-board apparatus 21 to the ground wireless apparatus 9. The ground wireless apparatus 9 transmits information including the presence position information on the train 20 received from the on-board wireless apparatus 22 to the information acquisition unit 3 of the train presence detection apparatus 1 (ground apparatus 10). Thus, the information acquisition unit 3 acquires the presence position information from the train 20 via the ground wireless apparatus 9. In the train 20, the pickup coil that detects ground coil information is provided on both a lead vehicle and a tail vehicle, and thereby a front end position and a rear end position of the train 20 can be obtained. In addition, one of the front end position and the rear end position of the train 20 may be obtained by providing the pickup coil to one of the lead and tail vehicles of the train 20, and the other of the front end position and the rear end position may be obtained by performing calculation using the train length.

For example, when the designated section determination unit 4 determines that the first section A1 illustrated in FIG. 2 is the designated section as illustrated in FIG. 4, the presence determination unit 5 determines whether the presence position (kilometrage) of the train 20 is included in the block sequence of the designated section (first section A1), thereby determining whether the train 20 is present in the designated section. More specifically, the presence determination unit 5 determines whether kilometrage at either the front end position or the rear end position of the train 20 is less than or equal to kilometrage (240) at the position of the first end point P1 of the designated section A1 or greater than or equal to kilometrage (800) at the position of the second end point P2 thereof, and when the kilometrage at either the front end position or the rear end position of the train 20 is determined to be less than or equal to the kilometrage (240) at the position of the first end point P1 of the designated section A1 or greater than or equal to the kilometrage (800) at the position of the second end point P2 thereof, the presence determination unit 5 determines that the train 20 is present in the designated section A1.

When the presence determination unit 5 determines that the train 20 is not present in the designated section, the approach determination unit 6 determines whether the distance from the train 20 to a starting end point is within a specific range, the starting end point being any of the first end point P1 and the second end point P2 that is closer to the train 20 in the traveling direction of the train 20. Even in a case where the train 20 is not present in the designated section, when the designated section is the temporary speed limit section or the train protection section, there may be a case where it is necessary to reduce the traveling speed of the train 20 or to stop the train 20 when the train 20 approaches the designated section. Therefore, the approach determination unit 6 determines whether the train 20 is approaching the designated section.

For example, on the basis of the route information that indicates a route on which the train 20 travels, the approach determination unit 6 determines whether the distance from the train 20 to the starting end point is within a specific range, the starting end point being an end point of the designated section closer to the train 20 in the traveling direction. The approach determination unit 6 determines whether the starting end point of the designated section is included in the route on which the train 20 travels, the route being indicated by the route information, and when the starting end point of the designated section is included in the route on which the train 20 travels, the approach determination unit 6 determines that the train 20 is approaching the designated section. For example, as illustrated in FIG. 4, a train 20*b* is not present in the designated section A1. However, the train 20*b* is present in the block [B1004], and the route information in accordance with which the train 20*b* travels is a route R1018 and indicates a travel route from kilometrage (500) at a position of a terminating end of the block [B1005] to kilometrage (200) at a position of a starting end of the block [B1003] in the clockwise direction. Therefore, the approach determination unit 6 determines that the route R1018 of the train 20*b* includes the first end point P1 (kilometrage is 240) that is a starting end point of the designated section A1, and the train 20*b* is determined to be approaching the designated section. On the other hand, a train 20*c* is present in the block [B1006], and the route information in accordance with which the train 20*c* travels is a route R1017 and indicates a travel route from kilometrage (700) at a position of a terminating end of the block [B1007] to kilometrage (400) at a position of a starting end of the block [B1005] in the clockwise direction, as illustrated in FIG. 3. Therefore, the approach determination unit 6 determines that the route R1017 of the train 20*c* does not include the first end point P1 (kilometrage is 240) that is the starting end point of the designated section A1, and the train 20*c* is determined to be not approaching the designated section. The method for determining by the approach determination unit 6 whether the train 20 is approaching the designated section is not limited to a method based on the route information. For example, whether the train 20 is approaching the designated section may be determined by calculating the distance from the front end position of the train 20 to the starting end point of the designated section and determining whether the distance falls in a specific distance range set depending on the types of the designated section or the like.

The train control unit 7 generates train control information for controlling the train 20. The train control information generated by the train control unit 7 is transmitted to the train 20 via the ground wireless apparatus 9. In the train 20, the on-board wireless apparatus 22 receives the train control information sent from the ground wireless apparatus 9, and the on-board wireless apparatus 22 outputs the train control information to the on-board apparatus 21. The on-board apparatus 21 performs control of travel and the like of the train 20 on the basis of the train control information received from the on-board wireless apparatus 22. The train control information includes, for example, temporary speed control information for decelerating the train 20 to a temporary speed limit and train protection information indicating an entry prohibited section for the train 20. The train control unit 7 generates train control information on the basis of the determination result of the presence determination unit 5 or the approach determination unit 6. When it is determined by the presence determination unit 5 that the train 20 is present in the designated section or it is determined by the approach determination unit 6 that the train 20 is approaching the designated section, the train control unit 7 generates train control information for performing travel control such that the traveling speed of the train 20 is reduced to a specific speed or lower or train control information for stopping the train 20, for example, depending on the types of the designated section.

Figure 8:
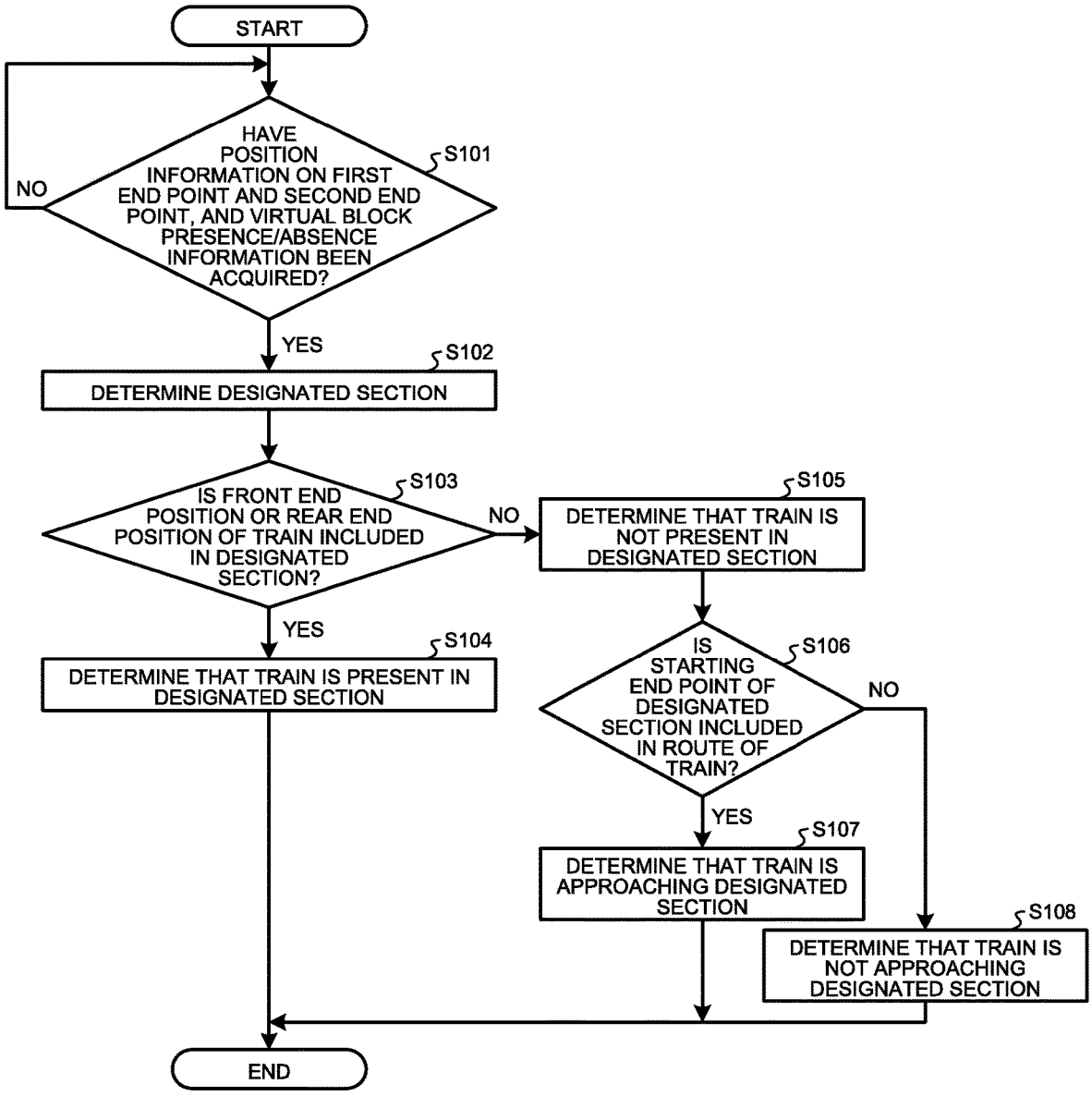
FIG. 8 is a flowchart illustrating an example of a flow of processes performed by the train presence detection apparatus according to the first embodiment of the present invention.

FIG. 8 is a flowchart illustrating an example of a flow of processes performed by the train presence detection apparatus 1 according to the first embodiment of the present invention. Hereinafter, the flow of processes performed by the train presence detection apparatus 1 will be described with reference to the flowchart of FIG. 8. In the train presence detection apparatus 1 according to the present embodiment, as illustrated in FIG. 8, the information acquisition unit 3 first determines whether the position information on the first end point P1 and the second end point P2 and the virtual block presence/absence information, which are input information received by the input reception unit 2, have been acquired (S101). When the information acquisition unit 3 determines that the position information on the first end point P1 and the second end point P2 and the virtual block presence/absence information have not been acquired (S101: No), the information acquisition unit 3 again determines whether the position information on the first end point P1 and the second end point P2 and the virtual block presence/absence information have been acquired (S101). That is, the information acquisition unit 3 repeats the determination of S101 until the position information on the first end point P1 and the second end point P2 and the virtual block presence/absence information are acquired. When the information acquisition unit 3 determines that the position information on the first end point P1 and the second end point P2 and the virtual block presence/absence information have been acquired (S101: Yes), the information acquisition unit 3 outputs the position information on the first end point P1 and the second end point P2 and the virtual block presence/absence information thus acquired to the designated section determination unit 4.

On the basis of the position information on the first end point P1 and the second end point P2 and the virtual block presence/absence information received from the information acquisition unit 3, the designated section determination unit 4 determines which of the first section A1 and the second section A2 in which the first end point P1 and the second end point P2 are located at both ends is the designated section, and generates a block sequence indicating the section (designated section) between two points that are the first end point P1 and the second end point P2 (S102).

The presence determination unit 5 determines whether the front end position or the rear end position of the train 20 is included in the block sequence of the designated section on the basis of the presence position information on the train 20 acquired by the information acquisition unit 3 and information on the designated section determined by the designated section determination unit 4 (S103). For example, as illustrated in FIG. 4, when the designated section determination unit 4 determines that the first section A1 illustrated in FIG. 2 is the designated section, the presence determination unit 5 first determines whether kilometrage at the front end position of the train 20 is less than or equal to the kilometrage (240) at the position of the first end point P1 of the designated section A1 or greater than or equal to the kilometrage (800) at the position of the second end point P2 thereof. When the presence determination unit 5 determines that the kilometrage at the front end position of the train 20 is less than or equal to the kilometrage (240) at the position of the first end point P1 of the designated section A1 or greater than or equal to the kilometrage (800) at the position of the second end point P2 thereof (S103: Yes), the presence determination unit 5 determines that the train 20 is present in the designated section A1 (S104), and ends the presence detection process performed by the train presence detection apparatus 1. That is, as illustrated in FIG. 4, a train 20*a* present in the block [B1002] whose kilometrage is 100 to 200 is determined by the presence determination unit 5 to be present in the designated section A1.

On the other hand, when the presence determination unit 5 determines that the kilometrage at the front end position of the train 20 is not less than or equal to the kilometrage (240) at the position of the first end point P1 of the designated section A1 and not greater than or equal to the kilometrage (800) at the position of the second end point P2 thereof, the presence determination unit 5 next determines whether the kilometrage at the rear end position of the train 20 is less than or equal to the kilometrage (240) at the position of the first end point P1 of the designated section A1 or greater than or equal to the kilometrage (800) at the position of the second end point P2 thereof. When the presence determination unit 5 determines that the kilometrage at the rear end position of the train 20 is less than or equal to the kilometrage (240) at the position of the first end point P1 of the designated section A1 or greater than or equal to the kilometrage (800) at the position of the second end point P2 thereof (S103: Yes), the presence determination unit 5 determines that the train 20 is present in the designated section (S104), and ends the presence detection process performed by the train presence detection apparatus 1. However, when the presence determination unit 5 determines that the kilometrage at the rear end position of the train 20 is not less than or equal to the kilometrage (240) at the position of the first end point P1 of the designated section A1 and not greater than or equal to the kilometrage (800) at the position of the second end point P2 thereof, that is, when the presence determination unit 5 determines that neither the kilometrage at the front end position of the train 20 nor that at the rear end position thereof is included in the designated section A1 (S103: No), the presence determination unit 5 determines that the train 20 is not present in the designated section (S105). That is, as illustrated in FIG. 4, the train 20*b* present in the block [B1004] whose kilometrage is 300 to 400 and the train 20*c* present in the block [B1006] whose kilometrage is 500 to 600 are determined by the presence determination unit 5 not to be present in the designated section A1.

When the presence determination unit 5 determines that the train 20 is not present in the designated section (S105), then the approach determination unit 6 determines whether the starting end point that is an end point of the designated section closer to the train 20 in the traveling direction of the train 20 is included in the route on which the train 20 travels, the route being indicated by the route information (S106). For example, when the train 20*b* is present in the block [B1004] as in illustrated in FIG. 4, the route information in accordance with which the train 20*b* travels is the route R1018 and indicates a travel route from the kilometrage (500) at the position of the terminating end of the block [B1005] to the kilometrage (200) at the position of the starting end of the block [B1003] in the clockwise direction, and therefore, the approach determination unit 6 determines that the first end point P1 (kilometrage is 240) that is the starting end point of the designated section A1 is included in the route R1018 of the train 20*b* (S106: Yes). Then, the approach determination unit 6 determines that the train 20*b* is approaching the designated section A1 (S107), and ends the presence detection process performed by the train presence detection apparatus 1.

On the other hand, for example, when the train 20*c* is present in the block [B1006] as in illustrated in FIG. 4, the route information in accordance with which the train 20*c* travels is the route R1017 and indicates a travel route from the kilometrage (700) at the position of the terminating end of the block [B1007] to the kilometrage (400) at the position of the starting end of the block [B1005] in the clockwise direction as illustrated in FIG. 3, and therefore, the approach determination unit 6 determines that the first end point P1 (kilometrage is 240) that is the starting end point of the designated section A1 is not included in the route R1017 of the train 20*c* (S106: No). Then, the approach determination unit 6 determines that the train 20*c* is not approaching the designated section A1 (S108), and ends the presence detection process performed by the train presence detection apparatus 1.

Figure 9:
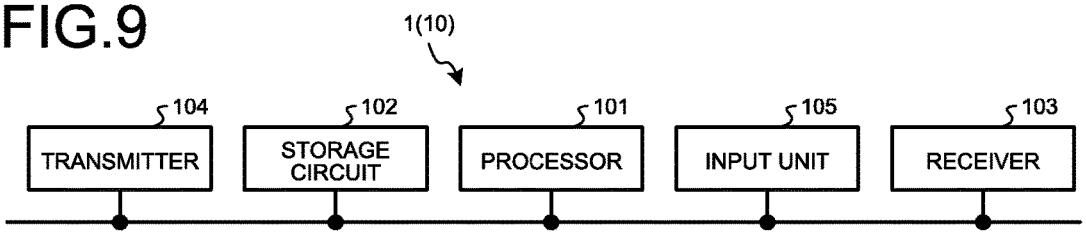
FIG. 9 is a diagram illustrating an example of a hardware configuration that implements the train presence detection apparatus illustrated in FIG. 1.

In the present embodiment described above, the train presence detection apparatus 1 (ground apparatus 10) includes a processor, a storage circuit, a receiver, and a transmitter, and each operation can be implemented by software. FIG. 9 is a diagram illustrating an example of a hardware configuration that implements the train presence detection apparatus 1 illustrated in FIG. 1. The train presence detection apparatus 1 illustrated in FIG. 9 includes a processor 101, a storage circuit 102, a receiver 103, a transmitter 104, and an input unit 105. The processor 101 uses received information to perform calculation and control by software, and the storage circuit 102 stores received information or information and software necessary for the processor 101 to perform calculation and control. The receiver 103 is an interface for receiving information from the outside. The transmitter 104 is an interface for transmitting information to the outside. The input unit 105 is an input interface for receiving input of various types of information. A plurality of individual processors 101, storage circuits 102, receivers 103, transmitters 104, and input units 105 may be provided. The input reception unit 2 illustrated in FIG. 1 is realized by the input unit 105. The information acquisition unit 3 is implemented by the processor 101 and the receiver 103. The designated section determination unit 4, the presence determination unit 5, and the approach determination unit 6 are implemented by the processor 101. The train control unit 7 is implemented by the processor 101 and the transmitter 104. The track database 8 is implemented by the storage circuit 102.

The train presence detection apparatus 1 according to the first embodiment of the present invention includes the information acquisition unit 3 that acquires position information on the first end point P1 and the second end point P2 located in the loop line section L1 and virtual block presence/absence information that indicates whether the virtual block VB indicating a specific position in the loop line section L1 is included in a designated section that is any of the first section A1 and the second section A2 in which the first end point P1 and the second end point P2 are located at both ends; the designated section determination unit 4 that determines which of the first section A1 and the second section A2 is the designated section on the basis of the position information on the first end point P1 and the second end point P2 and the virtual block presence/absence information acquired by the information acquisition unit 3; and the presence determination unit 5 that determines whether the train 20 is present in the designated section determined by the designated section determination unit 4. Consequently, it is possible to determine the designated section designated in the loop line section L1 and to determine whether the train 20 is present in the designated section.

The train presence detection apparatus 1 according to the first embodiment of the present invention includes the input reception unit 2 that receives input of the position information on the first end point P1 and the second end point P2 and the virtual block presence/absence information, and the information acquisition unit 3 acquires the position information on the first end point P1 and the second end point P2 and the virtual block presence/absence information received by the input reception unit 2. Consequently, it is possible to acquire information on an appropriate designated section in accordance with a situation.

According to the train presence detection apparatus 1 of the first embodiment of the present invention, the input reception unit 2 is provided in the ground apparatus 10 that performs wireless communication with the train 20. Consequently, it is possible to input information on an appropriate designated section in accordance with a situation in the loop line section L1.

The train presence detection apparatus 1 according to the first embodiment of the present invention includes the approach determination unit 6 that, when the presence determination unit 5 determines that the train 20 is not present in the designated section, determines whether the distance from the train 20 to a starting end point is within a specific range, the starting end point being any of the first end point P1 and the second end point P2 that is closer to the train 20 in the traveling direction of the train 20. Consequently, even in a case where the train 20 is not present in the designated section, when the designated section is the temporary speed limit section or the train protection section, it is possible to determine whether the train 20 is approaching the designated section.

Figure 10:
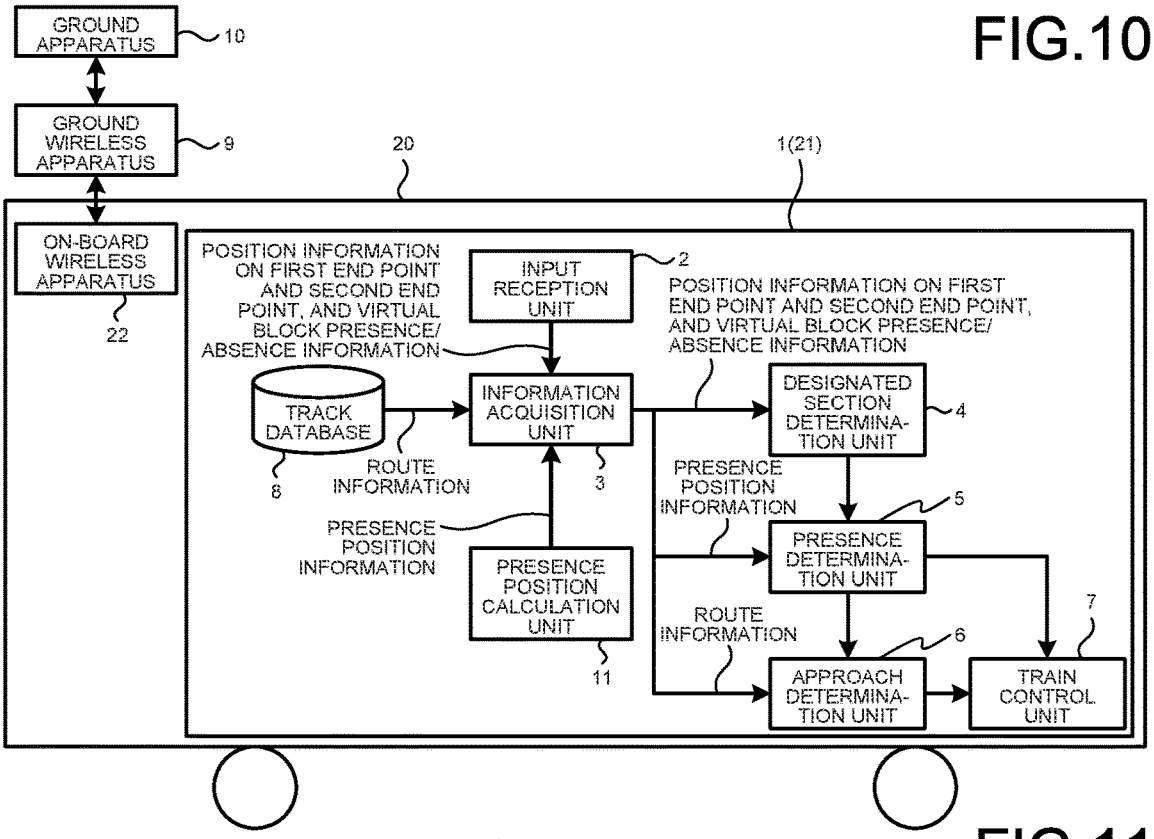
FIG. 10 is a block diagram illustrating another example of the configuration of the train presence detection apparatus according to the first embodiment of the present invention.

In the present embodiment, the description of the train presence detection apparatus 1 is given by taking the example in which the train presence detection apparatus 1 is configured from the ground apparatus 10 that performs wireless communication with the train 20 via the ground wireless apparatus 9, but there is no limitation thereto. FIG. 10 is a block diagram illustrating another example of the configuration of the train presence detection apparatus according to the first embodiment of the present invention. As illustrated in FIG. 10, the on-board apparatus 21 included in the train 20 may be configured as the train presence detection apparatus 1. Regarding configurations and the like similar to those of the train presence detection apparatus 1 illustrated in FIG. 1, same reference numerals are given thereto, and detailed descriptions thereof will be omitted.

The train presence detection apparatus 1 illustrated in FIG. 10 includes a presence position calculation unit 11 that acquires presence position information on the train 20, in addition to the input reception unit 2 that receives input of information, the information acquisition unit 3 that acquires various types of information, the designated section determination unit 4 that determines a designated section designated in the loop line section L1 on the basis of the information acquired by the information acquisition unit 3, the presence determination unit 5 that determines whether the train 20 is present in the designated section determined by the designated section determination unit 4, the approach determination unit 6 that determines whether the train 20 is approaching the designated section, the train control unit 7 that generates train control information for controlling the train 20 traveling in the loop line section L1, and the track database 8 that stores route information that is information on a route on which the train 20 travels.

For example, when the train 20 passes the ground coil installed at the starting end of each of the blocks [B1001] to [B1010] set in the loop line section L, the presence position calculation unit 11 receives ground coil information detected by the pickup coil in the train 20 as pickup coil information, detects the position of the ground coil by the pickup coil information, uses an absolute position of the ground coil as a reference position, calculates a travel distance from the reference position, for example, on the basis of speed information detected by a rate generator attached to an axle, and obtains an intra-block position that is a position of the train 20 in a block, thereby calculating presence position information on the train 20 to which the presence position calculation unit 11 belongs. The presence position calculation unit 11 outputs the calculated presence position information on the train 20 to the information acquisition unit 3.

Although not illustrated in detail, the train presence detection apparatus 1 may be configured as a train control system including the ground apparatus 10 and the on-board apparatus 21. When the train presence detection apparatus 1 is configured as the train control system including the ground apparatus 10 and the on-board apparatus 21, a configuration may be employed in which, for example, the ground apparatus 10 has functions of the input reception unit 2, the information acquisition unit 3, and the designated section determination unit 4, and the on-board apparatus 21 has functions of the presence determination unit 5, the approach determination unit 6, the train control unit 7, the track database 8, and the presence position calculation unit 11. In such a case, in the train presence detection apparatus 1, the input reception unit 2 of the ground apparatus 10 receives input of the position information on the first end point P1 and the second end point P2 located at both ends of the designated section and the virtual block presence/absence information that indicates whether the virtual block VB indicating a specific position in the loop line section is included in the designated section, and outputs the above pieces of information to the information acquisition unit 3. The information acquisition unit 3 acquires the position information on the first end point P1 and the second end point P2 and the virtual block presence/absence information that are input information received by the input reception unit 2, and outputs the above pieces of information to the designated section determination unit 4. On the basis of the position information on the first end point P1 and the second end point P2 and the virtual block presence/absence information acquired by the information acquisition unit 3, the designated section determination unit 4 determines which of the first section A1 and the second section A2 is the designated section, generates a block sequence of the section (designated section) between two points that are the first end point P1 and the second end point P2, as illustrated in each of FIGS. 6 and 7, and transmits the block sequence to the on-board apparatus 21 via the ground wireless apparatus 9. When the on-board apparatus 21 receives, via the on-board wireless apparatus 22, information on the block sequence indicating the designated section generated by the designated section determination unit 4, the presence determination unit 5 may determine whether the train 20 is present in the designated section by determining whether the presence position of the train 20 is included in the block sequence indicating the designated section.

Second Embodiment

Figure 11:
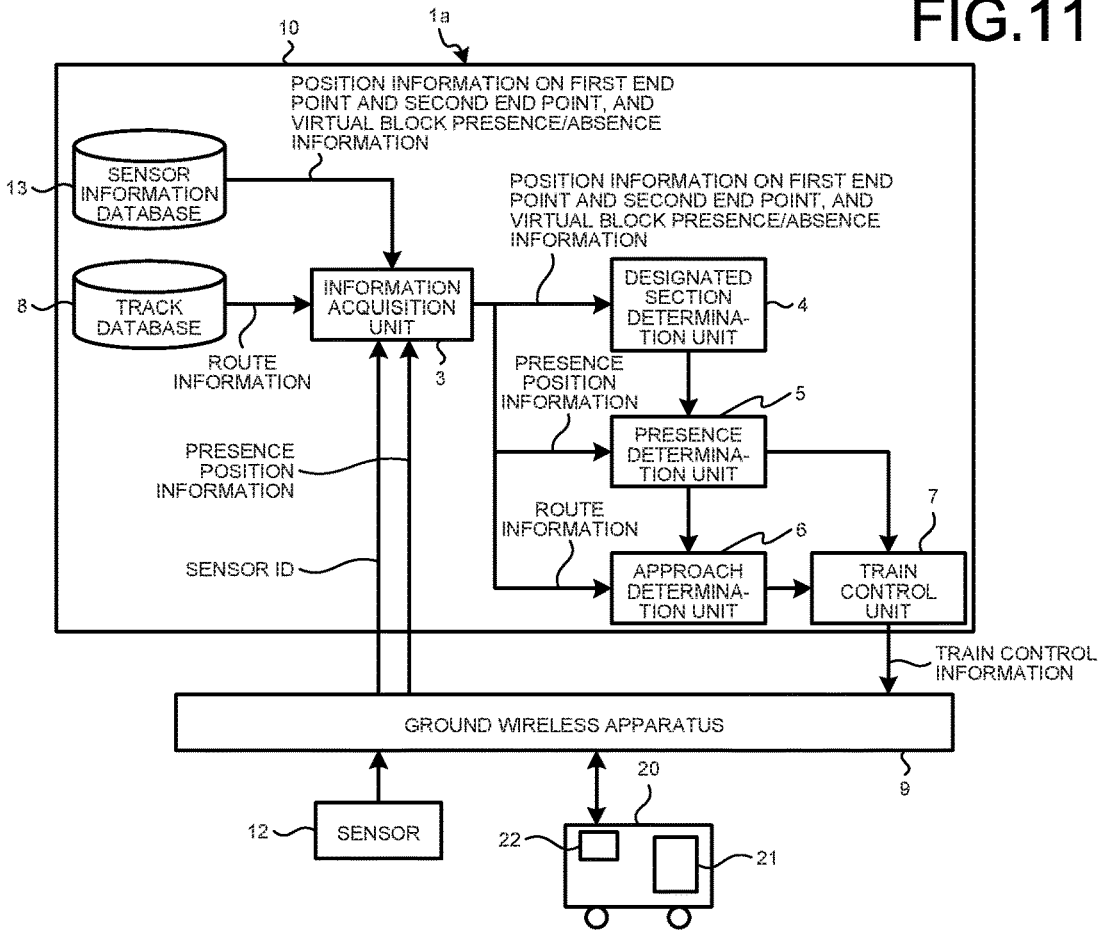
FIG. 11 is a block diagram illustrating an example of a configuration of a train presence detection apparatus according to a second embodiment of the present invention.

Next, a train presence detection apparatus 1*a* according to a second embodiment of the present invention will be described. FIG. 11 is a block diagram illustrating an example of a configuration of the train presence detection apparatus according to the second embodiment of the present invention. As illustrated in FIG. 11, the train presence detection apparatus 1*a* includes, instead of the input reception unit 2 included in the train presence detection apparatus 1 illustrated in FIG. 1 according to the first embodiment, a sensor 12 that detects a state in the loop line section L or around the loop line section L and a sensor information database 13. Regarding configurations and the like similar to those of the train presence detection apparatus 1 according to the first embodiment of the present invention, same reference numerals are given thereto, and detailed descriptions thereof will be omitted.

Multiple sensors 12 are installed at specific intervals in the loop line section L1 or around the loop line section L1, for example, and each sensor 12 detects a state in the loop line section L1 or around the loop line section L1. Examples of sensors usable as the sensors 12 include a wind speed sensor that detects a wind speed around the loop line section L1, a rock fall detection sensor that detects occurrence of a rock fall on a slope or the like along the loop line section L1, a seismic sensor that detects occurrence of an earthquake in an area around the position of the loop line section L1, a liquid level sensor that detects the height or the like of the water surface of a river that the loop line section L1 crosses or a river along the loop line section L1, and various types of weather sensors that detect the amounts of snowfall, rainfall, and the like in the loop line section L1 or around the loop line section L1. When any sensor 12 detects a specific state for which travel control of the train 20 needs to be performed, the sensor 12 transmits, to the information acquisition unit 3 via the ground wireless apparatus 9, its own sensor ID the sensor 12 has. An example of the specific state when the sensor 12 is a wind speed sensor is a state in which wind is blowing at a speed higher than a predetermined wind speed.

Figures 12, 13:
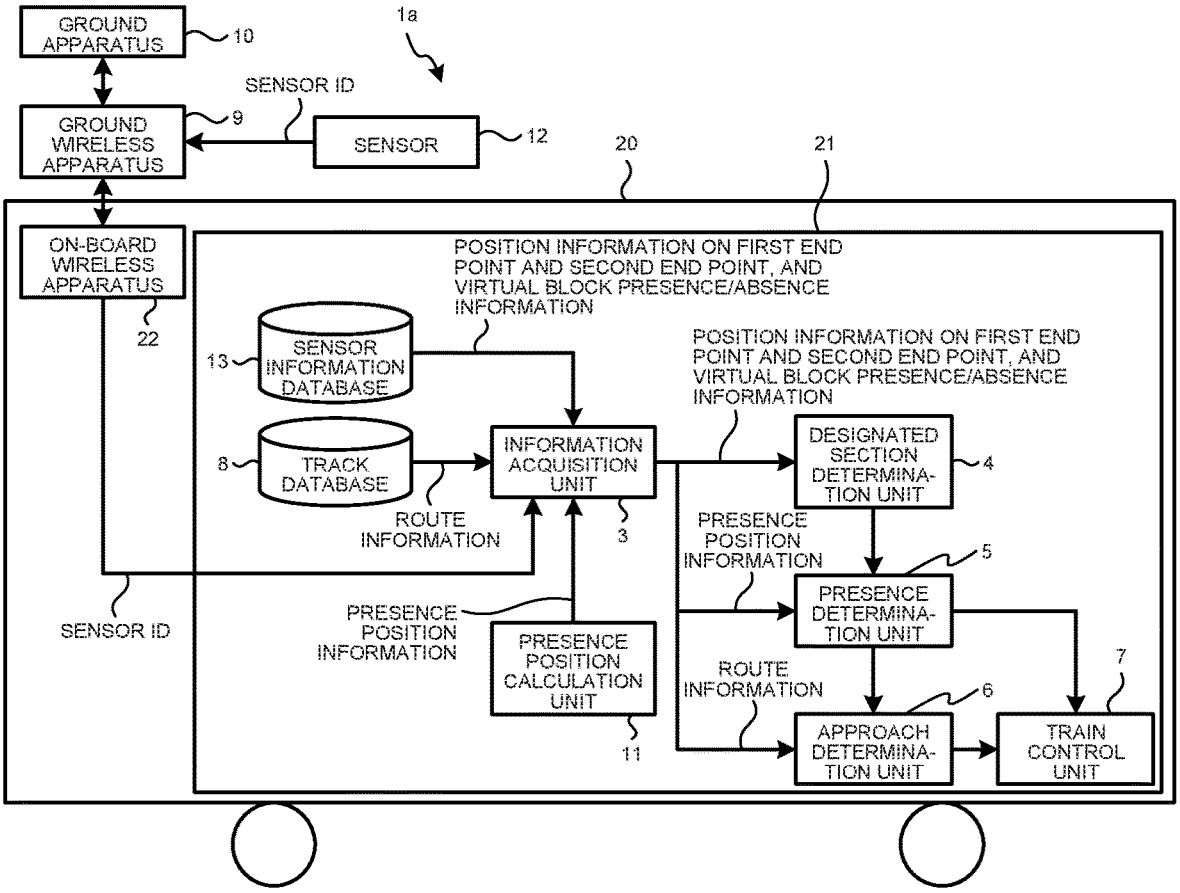
FIG. 12 is a diagram illustrating an example of a data configuration including virtual block presence/absence information stored in a sensor information database.
FIG. 13 is a block diagram illustrating another example of the configuration of the train presence detection apparatus according to the second embodiment of the present invention.

FIG. 12 is a diagram illustrating an example of a data configuration including the virtual block presence/absence information stored in the sensor information database. For example, as illustrated in FIG. 12, the sensor information database 13 stores, in association with the sensor ID, the position information on the first end point P1 and the second end point P2 located at both ends of the designated section and the virtual block presence/absence information indicating whether the virtual block VB is included in the designated section. In the train presence detection apparatus 1*a*, when the sensor 12 detects a specific state and when the information acquisition unit 3 receives the sensor ID from the sensor 12, the information acquisition unit 3 accesses the sensor information database 13 on the basis of the received sensor ID, and acquires the position information on the first end point P1 and the second end point P2 and the virtual block presence/absence information indicating whether the virtual block VB is included in the designated section, where the position information and the virtual block presence/absence information correspond to the received sensor ID. Thus, the train presence detection apparatus 1*a* can determine the designated section by the designated section determination unit 4 similarly to the train presence detection apparatus 1 illustrated in FIG. 1. The position information on the first end point P1 and the second end point P2 is not designated as a coordinate value of the virtual block VB, similarly to the train presence detection apparatus 1 according to the first embodiment. That is, the first end point Pl, the second end point P2, and the virtual block VB are all set to have different coordinate values. When it is desired to designate either the first end point P1 or the second end point P2 as the coordinate value of the virtual block VB, the position information on the first end point P1 or the second end point P2 may be stored such that the virtual block VB is included in the designated section with allowance. Although only one sensor 12 is illustrated in FIG. 11, multiple sensors 12 are installed at specific intervals in the loop line section L1 or around the loop line section L1, and different types of multiple sensors 12 may be installed in accordance with a situation of a place where the loop line section L1 passes. FIG. 11 illustrates the example in which the sensor information database 13 is provided in the ground apparatus 10, but the sensor information database 13 may be provided outside the ground apparatus 10. Although FIG. 11 illustrates the example in which the information acquisition unit 3 acquires information from the sensor 12 via the ground wireless apparatus 9, there is no limitation thereto, and the information acquisition unit 3 may be configured to acquire information via a wired connection. Components from which the information acquisition unit 3 acquires the position information on the first end point P1 and the second end point P2 and the virtual block presence/absence information are not limited to the input reception unit 2 and the sensor information database 13, and the information acquisition unit 3 may be configured to acquire the above pieces of information from another device or the like.

The train presence detection apparatus 1*a* according to the second embodiment of the present invention includes the sensors 12 each of which detects a state in the loop line section L1 or around the loop line section L1 and the sensor information database 13 that stores, in association with an ID each sensor 12 has, the position information on the first end point of P1 and the second end point P2 and the virtual block presence/absence information. When any sensor 12 detects a specific state, the information acquisition unit 3 acquires the position information on the first end point P1 and the second end point P2 and the virtual block presence/absence information from the sensor information database 13 on the basis of the ID the sensor 12 has. Consequently, it is possible to determine the designated section efficiently in accordance with a state in the loop line section L1 or around the loop line section L1 detected by the sensor 12.

FIG. 13 is a block diagram illustrating another example of the configuration of the train presence detection apparatus according to the second embodiment of the present invention. Similarly to the train presence detection apparatus 1 according to the first embodiment, the train presence detection apparatus 1*a* according to the second embodiment may also be configured to include the sensor information database 13 in the on-board apparatus 21 included in the train, as illustrated in FIG. 13, in addition to the information acquisition unit 3, the designated section determination unit 4, the presence determination unit 5, the approach determination unit 6, the train control unit 7, the track database 8, and the presence position calculation unit 11. In the train presence detection apparatus 1*a* illustrated in FIG. 13, when the sensor 12 detects a specific state for which travel control of the train 20 needs to be performed, the sensor 12 transmits its own sensor ID the sensor 12 has to the on-board wireless apparatus 22 via the ground wireless apparatus 9, and the on-board wireless apparatus 22 transmits the sensor ID to the information acquisition unit 3. Then, the information acquisition unit 3 accesses the sensor information database 13 on the basis of the received sensor ID, and acquires the position information on the first end point P1 and the second end point P2 and the virtual block presence/absence information indicating whether the virtual block VB is included in the designated section, where the position information and the virtual block presence/absence information correspond to the received sensor ID. Thus, the train presence detection apparatus 1*a* illustrated in FIG. 13 can determine the designated section by the designated section determination unit 4. Although not illustrated in detail, the train presence detection apparatus 1*a* may also be configured as a train control system including the ground apparatus 10 and the on-board apparatus 21 similarly to the train presence detection apparatus 1 according to the first embodiment.

Figure 14:
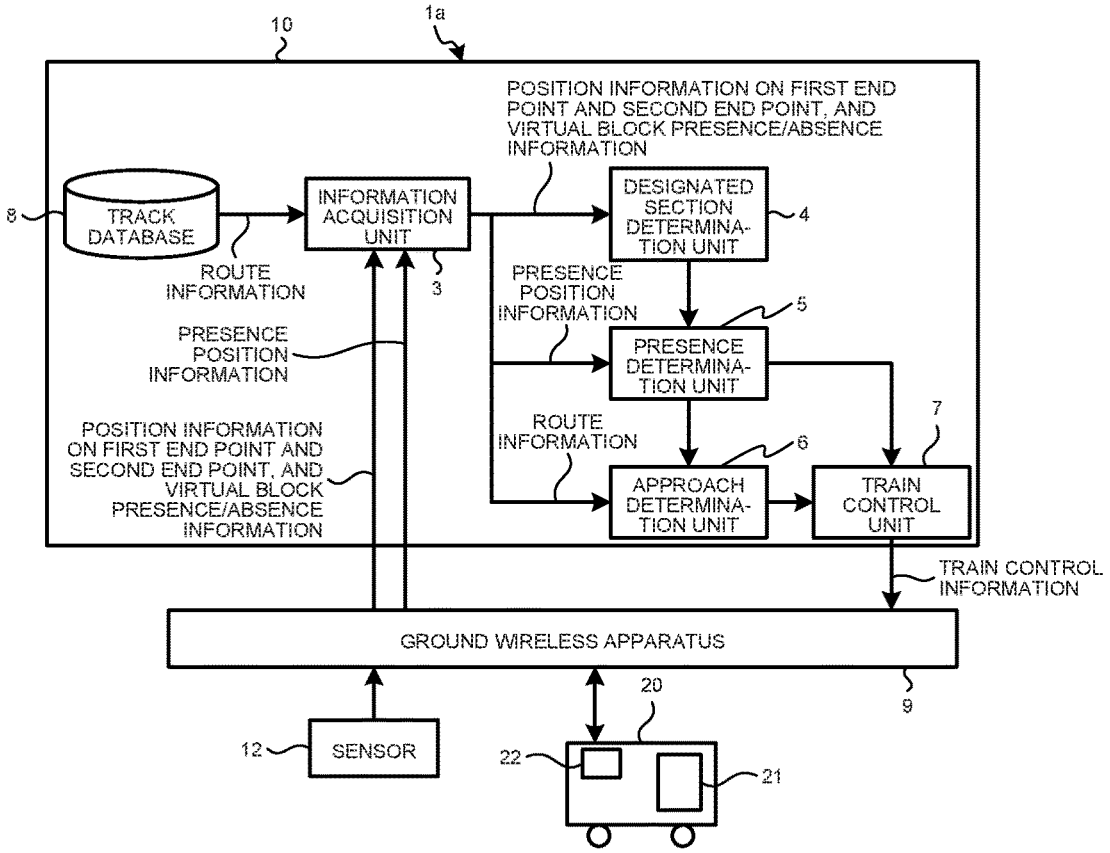
FIG. 14 is a block diagram illustrating still another example of the configuration of the train presence detection apparatus according to the second embodiment of the present invention.

FIG. 14 is a block diagram illustrating still another example of the configuration of the train presence detection apparatus according to the second embodiment of the present invention. In the train presence detection apparatus 1*a* illustrated in FIG. 14, for example, the sensor 12 has stored in advance the position information on the first end point Pl, the position information on the second end point P2, and the virtual block presence/absence information in a storage unit (not illustrated), and is configured to transmit the position information on the first end point P1 and the second end point P2 and the virtual block presence/absence information to the information acquisition unit 3 via the ground wireless apparatus 9 when a specific state is detected. Thus, in the train presence detection apparatus 1*a* illustrated in FIG. 14, although the ground apparatus 10 does not include the sensor information database 13, the information acquisition unit 3 can acquire the position information on the first end point P1 and the second end point P2 and the virtual block presence/absence information.

Figure 15:
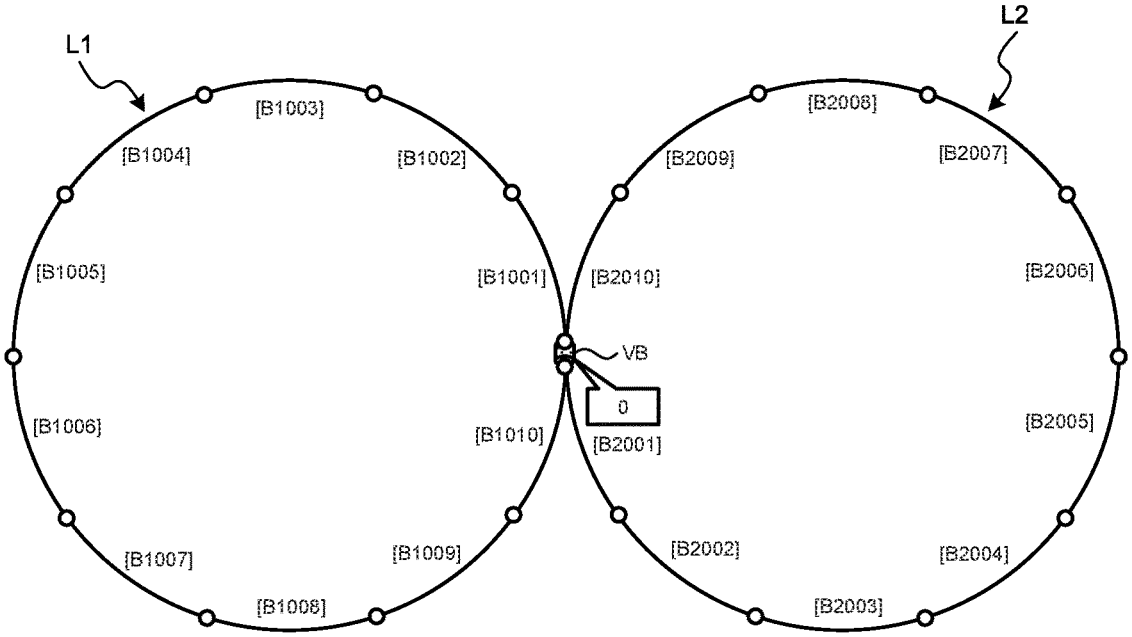
FIG. 15 is a diagram illustrating an example of the virtual block in a case where a second line section formed in a loop is connected adjacent to the first line section.

FIG. 15 is a diagram illustrating an example of a virtual block in a case where a loop line section L2, which is a second line section formed in a loop, is connected adjacent to the loop line section L1. Although FIG. 2 illustrates the example in which the virtual block VB is set in one loop line section L1, for example, as illustrated in FIG. 15, when the loop line sections L1 and L2 different from each other are adjacently connected, the virtual block VB may be set at a connection point where the loop line sections L1 and L2 are connected. Thus, the loop line section L1 and the loop line section L2 can share and use the virtual block VB, and thereby the number of virtual blocks VB can be reduced by one as compared with a case where the virtual block VB is provided in each of the loop line section L1 and the loop line section L2, which is efficient.

Third Embodiment

Figure 16:
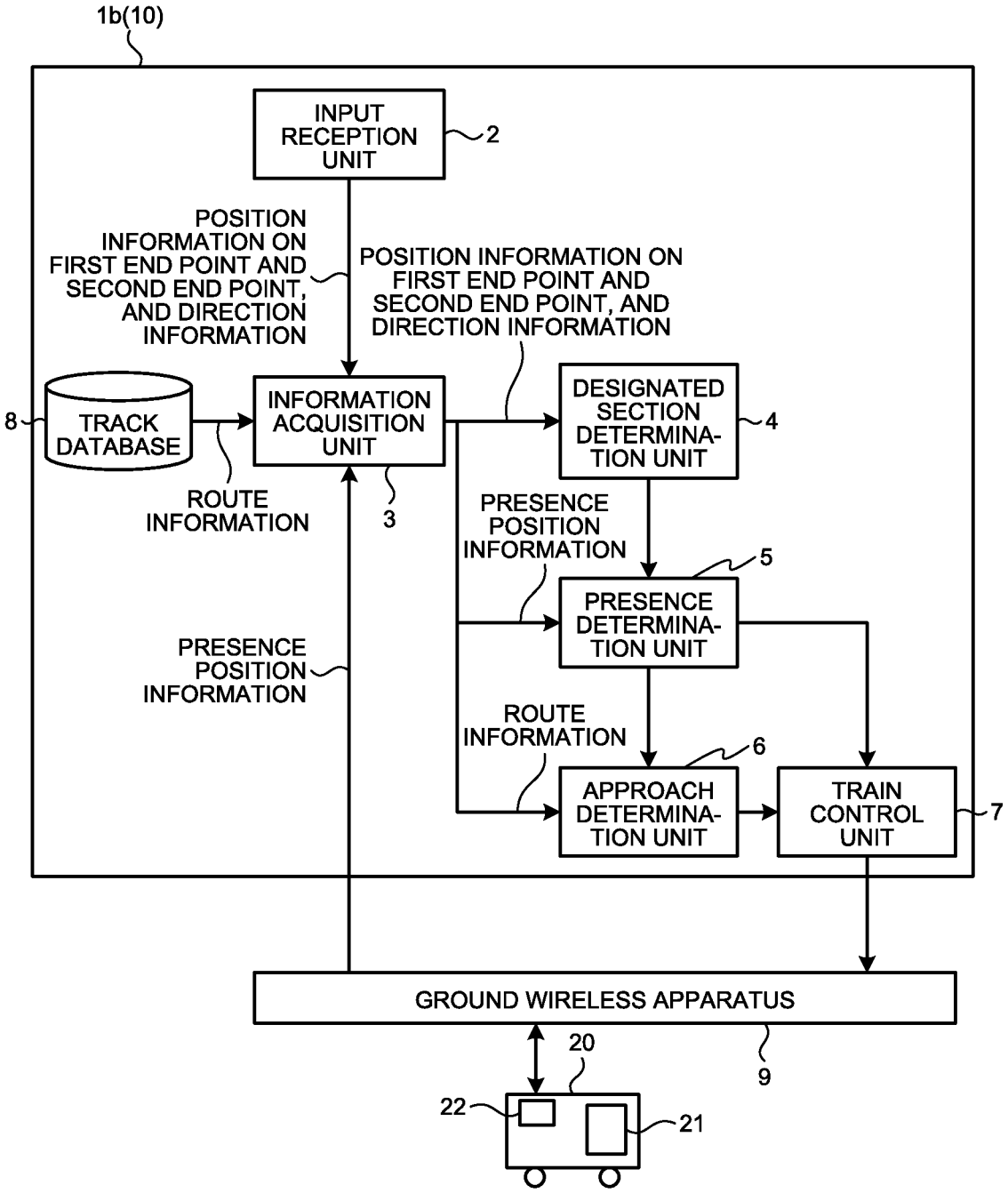
FIG. 16 is a block diagram illustrating an example of a configuration of a train presence detection apparatus according to a third embodiment of the present invention.
Figure 17:
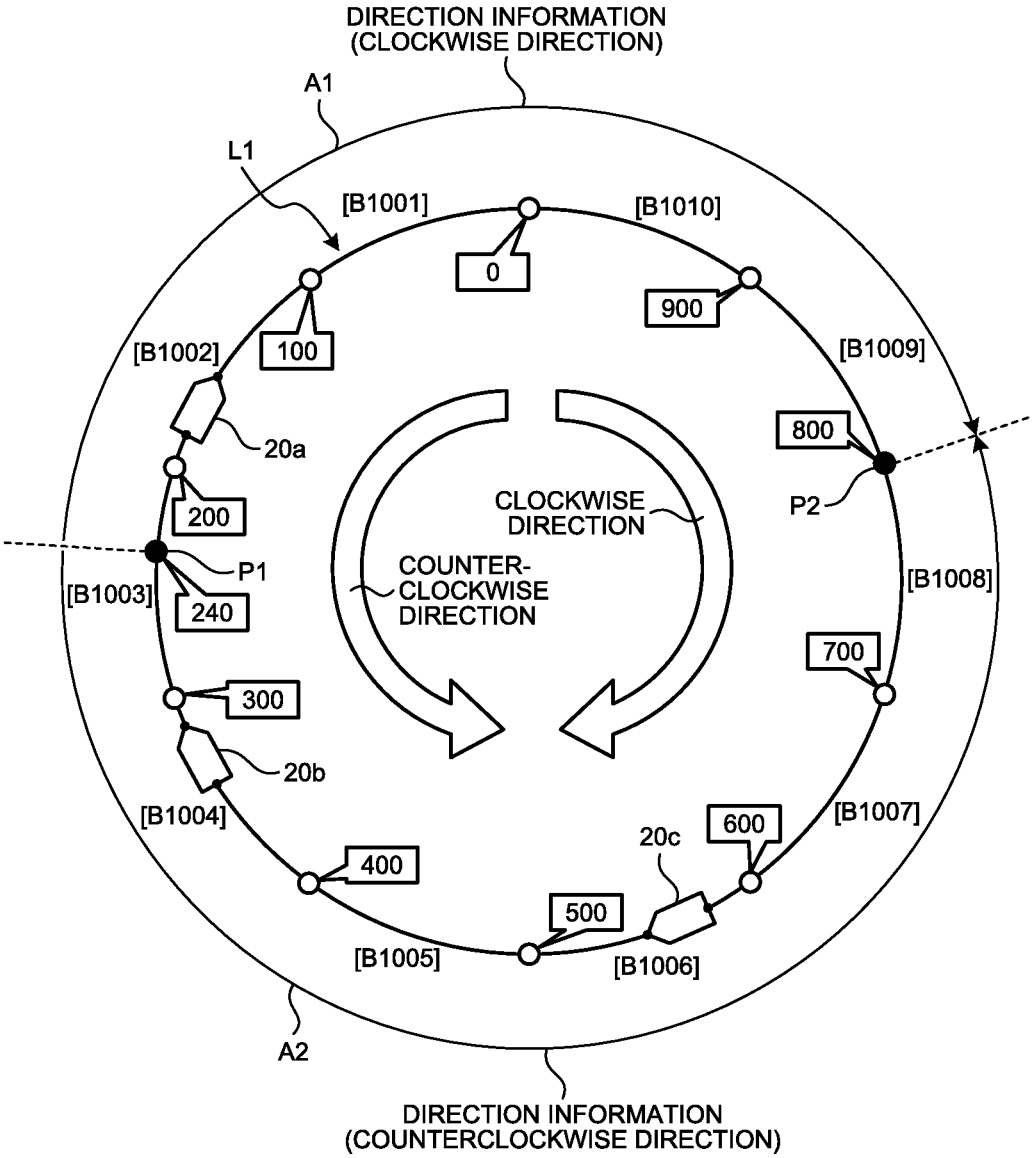
FIG. 17 is a diagram illustrating examples of blocks set in the first line section formed in a loop and direction information.

Next, a train presence detection apparatus 1*b* according to a third embodiment of the present invention will be described. FIG. 16 is a block diagram illustrating an example of a configuration of the train presence detection apparatus according to the third embodiment of the present invention. FIG. 17 is a diagram illustrating examples of blocks set in the first line section formed in a loop and direction information. In the train presence detection apparatus 1*b* according to the third embodiment of the present invention, as illustrated in FIGS. 16 and 17, the input reception unit 2 receives input of the position information on the first end point P1 and the second end point P2 located in the loop line section L1, and input of the direction information for indicating in which direction (clockwise or counterclockwise direction) from the first end point (starting end) P1 to the second end point (terminating end) P2 the designated section is located, the designated section being any of the first section A1 and the second section A2 in which the first end point P1 and the second end point P2 are located at both ends, and the information acquisition unit 3 acquires the position information on the first end point P1 and the second end point P2 and the direction information received by the input reception unit 2. Regarding configurations and the like similar to those of the train presence detection apparatus 1 according to the first embodiment of the present invention, same reference numerals are given thereto, and detailed descriptions thereof will be omitted.

In the train presence detection apparatus 1*b*, the designated section determination unit 4 determines which of the first section A1 and the second section A2 is the designated section on the basis of the position information on the first end point P1 and the second end point P2 and the direction information acquired by the information acquisition unit 3. It is impossible to determine which of the first section A1 and the second section A2 is the designated section only with the position information on the first end point P1 and the second end point P2 indicating the positions of both ends of the designated section, as illustrated in FIG. 17. Therefore, the train presence detection apparatus 1*b* uses the direction information for indicating in which direction (clockwise or counterclockwise direction) from the first end point P1 to the second end point P2 the designated section is located.

FIG. 18 is a diagram illustrating an example of a case where the designated section is located in a clockwise direction from the first end point to the second end point. FIG. 19 is a diagram illustrating an example of a case where the designated section is located in a counterclockwise direction from the first end point to the second end point. For example, when the designated section determination unit 4 acquires, as the direction information, information indicating that the designated section is located in the clockwise direction from the first end point P1 to the second end point P2, as illustrated in FIG. 18, the designated section determination unit 4 determines that the first section A1 that is located in the clockwise direction from the first end point P1 to the second end point P2 is the designated section. Alternatively, when the designated section determination unit 4 acquires, as the direction information, information indicating that the designated section is located in the counterclockwise direction from the first end point P1 to the second end point P2, as illustrated in FIG. 19, the designated section determination unit 4 determines that the second section A2 that is located in the counterclockwise direction from the first end point P1 to the second end point P2 is the designated section. In addition, when the designated section is determined, the designated section determination unit 4 generates a block sequence of the section (designated section) between two points that are the first end point P1 and the second end point P2, as illustrated in each of FIGS. 6 and 7, similarly to the train presence detection apparatus 1 illustrated in FIG. 1. The presence determination unit 5 determines whether the presence position (kilometrage) of the train 20 is included in the block sequence generated by the designated section determination unit 4, thereby determining whether the train 20 is present in the designated section.

Figure 20:
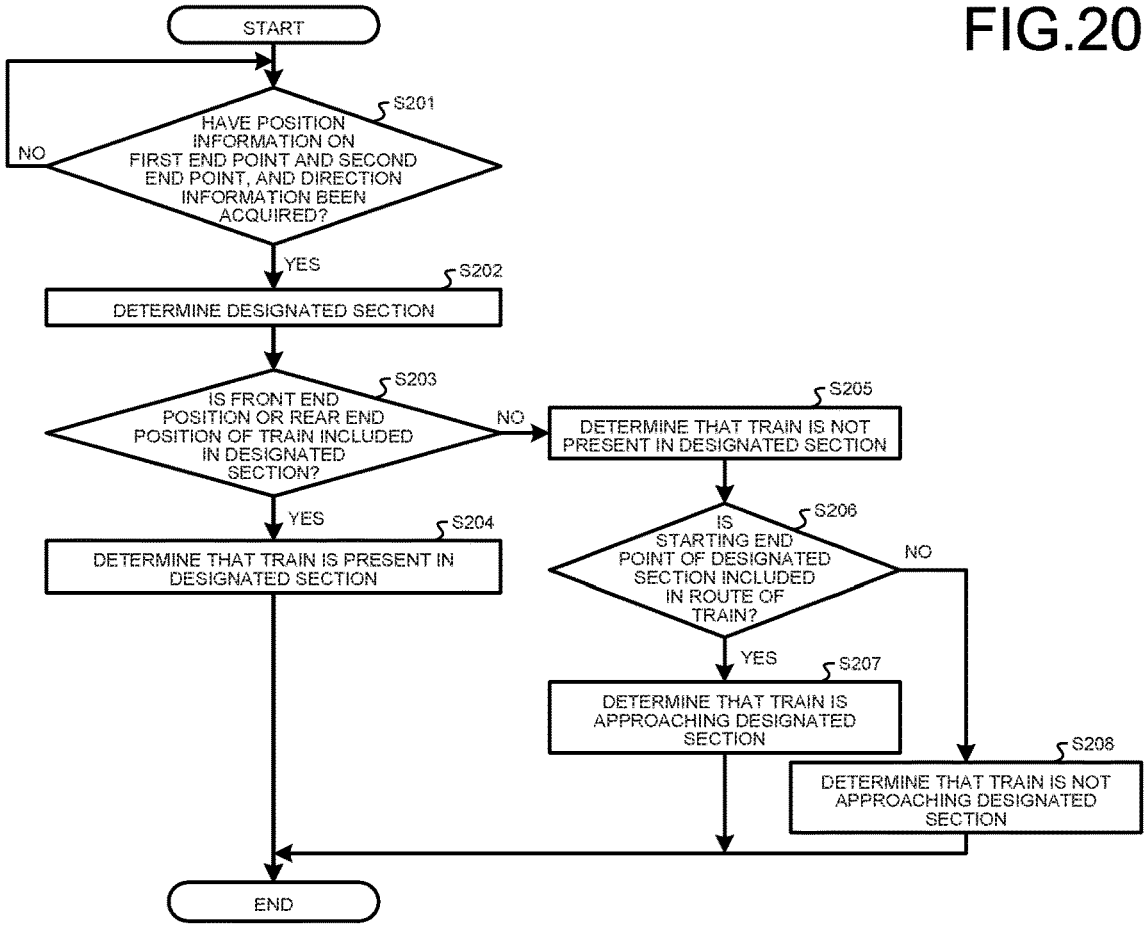
FIG. 20 is a flowchart illustrating an example of a flow of processes performed by the train presence detection apparatus according to the third embodiment of the present invention.

FIG. 20 is a flowchart illustrating an example of a flow of processes performed by the train presence detection apparatus according to the third embodiment of the present invention. Hereinafter, the flow of processes performed by the train presence detection apparatus 1*b* will be described with reference to the flowchart of FIG. 20. In the train presence detection apparatus 1*b* according to the present embodiment, as illustrated in FIG. 20, the information acquisition unit 3 first determines whether the position information on the first end point P1 and the second end point P2 and the direction information, which are input information received by the input reception unit 2, have been acquired (S201). When the information acquisition unit 3 determines that the position information on the first end point P1 and the second end point P2 and the direction information have not been acquired (S201: No), the information acquisition unit 3 again determines whether the position information on the first end point P1 and the second end point P2 and the direction information have been acquired (S201). That is, the information acquisition unit 3 repeats the determination of S201 until the position information on the first end point P1 and the second end point P2 and the direction information are acquired. When the information acquisition unit 3 determines that the position information on the first end point P1 and the second end point P2 and the direction information have been acquired (S201: Yes), the information acquisition unit 3 outputs the position information on the first end point P1 and the second end point P2 and the direction information thus acquired to the designated section determination unit 4.

On the basis of the position information on the first end point P1 and the second end point P2 and the direction information received from the information acquisition unit 3, the designated section determination unit 4 determines which of the first section A1 and the second section A2 in which the first end point P1 and the second end point P2 are located at both ends is the designated section, and generates a block sequence indicating the section (designated section) between two points that are the first end point P1 and the second end point P2 (S202).

The presence determination unit 5 determines whether the front end position or the rear end position of the train 20 is included in the block sequence of the designated section on the basis of the presence position information on the train 20 acquired by the information acquisition unit 3 and the information on the designated section determined by the designated section determination unit 4 (S203). For example, as illustrated in FIG. 18, when the designated section determination unit 4 determines that the first section A1 illustrated in FIG. 17 is the designated section, the presence determination unit 5 first determines whether kilometrage at the front end position of the train 20 is less than or equal to the kilometrage (240) at the position of the first end point P1 of the designated section A1 or greater than or equal to the kilometrage (800) at the position of the second end point P2 thereof. When the presence determination unit 5 determines that the kilometrage at the front end position of the train 20 is less than or equal to the kilometrage (240) at the position of the first end point P1 of the designated section A1 or greater than or equal to the kilometrage (800) at the position of the second end point P2 thereof (S203: Yes), the presence determination unit 5 determines that the train 20 is present in the designated section A1 (S204), and ends the presence detection process performed by the train presence detection apparatus 1*b*. That is, as illustrated in FIG. 17, the train 20*a* present in the block [B1002] whose kilometrage is 100 to 200 is determined by the presence determination unit 5 to be present in the designated section A1.

On the other hand, when the presence determination unit 5 determines that the kilometrage at the front end position of the train 20 is not less than or equal to the kilometrage (240) at the position of the first end point P1 of the designated section A1 and not greater than or equal to the kilometrage (800) at the position of the second end point P2 thereof, the presence determination unit 5 next determines whether the kilometrage at the rear end position of the train 20 is less than or equal to the kilometrage (240) at the position of the first end point P1 of the designated section A1 or greater than or equal to the kilometrage (800) at the position of the second end point P2 thereof. When the presence determination unit 5 determines that the kilometrage at the rear end position of the train 20 is less than or equal to the kilometrage (240) at the position of the first end point P1 of the designated section A1 or greater than or equal to the kilometrage (800) at the position of the second end point P2 thereof (S203: Yes), the presence determination unit 5 determines that the train 20 is present in the designated section (S204), and ends the presence detection process performed by the train presence detection apparatus 1*b*. However, when the presence determination unit 5 determines that the kilometrage at the rear end position of the train 20 is not less than or equal to the kilometrage (240) at the position of the first end point P1 of the designated section A1 and not greater than or equal to the kilometrage (800) at the position of the second end point P2 thereof, that is, when the presence determination unit 5 determines that neither the kilometrage at the front end position of the train 20 nor that at the rear end position thereof is included in the designated section A1 (S203: No), the presence determination unit 5 determines that the train 20 is not present in the designated section (S205). That is, as illustrated in FIG. 17, the train 20*b* present in the block [B1004] whose kilometrage is 300 to 400 and the train 20*c* present in the block [B1006] whose kilometrage is 500 to 600 are determined by the presence determination unit 5 not to be present in the designated section A1.

When the presence determination unit 5 determines that the train 20 is not present in the designated section (S205), then the approach determination unit 6 determines whether the starting end point that is an end point of the designated section closer to the train 20 in a traveling direction of the train 20 is included in the route on which the train 20 travels, the route being indicated by the route information (S206). For example, when the train 20*b* is present in the block [B1004] as in illustrated in FIG. 17, the route information in accordance with which the train 20*b* travels is the route R1018 and indicates a travel route from the kilometrage (500) at the position of the terminating end of the block [B1005] to the kilometrage (200) at the position of the starting end of the block [B1003] in the clockwise direction, and therefore, the approach determination unit 6 determines that the first end point P1 (kilometrage is 240) that is the starting end point of the designated section A1 is included in the route R1018 of the train 20*b* (S206: Yes). Then, the approach determination unit 6 determines that the train 20*b* is approaching the designated section A1 (S207), and ends the presence detection process performed by the train presence detection apparatus 1*b*.

On the other hand, for example, when the train 20*c* is present in the block [B1006] as in illustrated in FIG. 17, the route information in accordance with which the train 20*c* travels is the route R1017 and indicates a travel route from the kilometrage (700) at the position of the terminating end of the block [B1007] to the kilometrage (400) at the position of the starting end of the block [B1005] in the clockwise direction, and therefore, the approach determination unit 6 determines that the first end point P1 (kilometrage is 240) that is the starting end point of the designated section A1 is not included in the route R1017 of the train 20*c* (S206: No). Then, the approach determination unit 6 determines that the train 20*c* is not approaching the designated section A1 (S208), and ends the presence detection process performed by the train presence detection apparatus 1*b*. The train presence detection apparatus 1*b* according to the third embodiment described above can also be implemented by a hardware configuration similar to that of the train presence detection apparatus 1.

The train presence detection apparatus 1*b* according to the third embodiment of the present invention includes the information acquisition unit 3 that acquires position information on the first end point P1 and the second end point P2 located in the loop line section L1 and direction information for indicating in which direction from the first end point P1 to the second end point P2 the designated section that is any of the first section A1 and the second section A2 in which the first end point P1 and the second end point P2 are located at both ends is located; the designated section determination unit 4 that determines which of the first section A1 and the second section A2 is the designated section on the basis of the position information on the first end point P1 and the second end point P2 and the direction information acquired by the information acquisition unit 3; and the presence determination unit 5 that determines whether the train 20 is present in the designated section determined by the designated section determination unit 4. Consequently, it is possible to determine the designated section designated in the loop line section L1 and to determine whether the train 20 is present in the designated section.

In the present embodiment, the description of the train presence detection apparatus 1*b* is given by taking the example in which the train presence detection apparatus 1*b* is configured from the ground apparatus 10 that performs wireless communication with the train 20 via the ground wireless apparatus 9, but there is no limitation thereto. The on-board apparatus 21 included in the train 20 may be configured as the train presence detection apparatus 1*b*, similarly to the train presence detection apparatus 1 illustrated in FIG. 10. The train presence detection apparatus 1*b* may be configured as a train control system including the ground apparatus 10 and the on-board apparatus 21.

Fourth Embodiment

Figure 21:
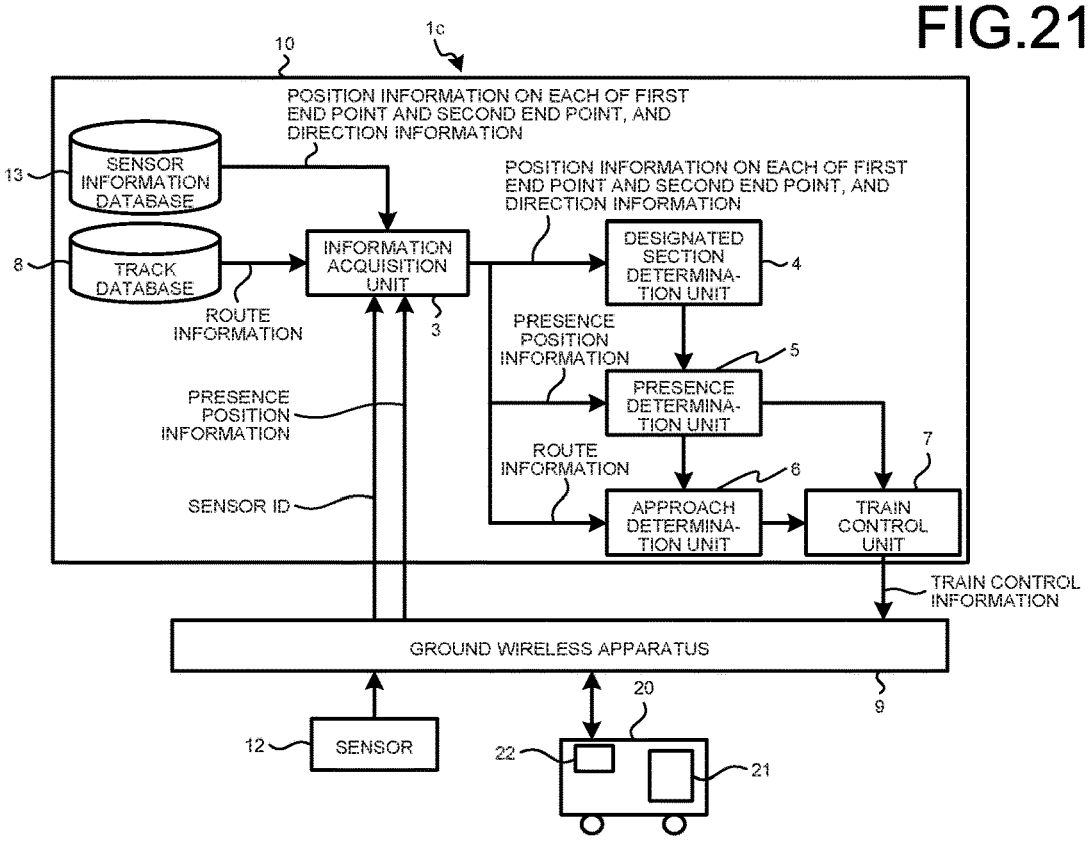
FIG. 21 is a block diagram illustrating an example of a configuration of a train presence detection apparatus according to a fourth embodiment of the present invention.

Next, a train presence detection apparatus 1*c* according to a fourth embodiment of the present invention will be described. FIG. 21 is a block diagram illustrating an example of a configuration of the train presence detection apparatus according to the fourth embodiment of the present invention. As illustrated in FIG. 21, the train presence detection apparatus 1*c* according to the fourth embodiment of the present invention includes, instead of the input reception unit 2 included in the train presence detection apparatus 1*b* illustrated in FIG. 16 according to the third embodiment, the sensor 12 that detects a state in the loop line section L1 or around the loop line section L1 and the sensor information database 13. Regarding configurations and the like similar to those of the train presence detection apparatus 1*b* according to the third embodiment of the present invention, same reference numerals are given thereto, and detailed descriptions thereof will be omitted.

Multiple sensors 12 are installed at specific intervals in the loop line section L1 or around the loop line section L1, for example, and each sensor 12 detects a state in the loop line section L1 or around the loop line section L1. Examples of sensors usable as the sensors 12 include the wind speed sensor, the rock fall detection sensor, the seismic sensor, the liquid level sensor, and the various types of weather sensors described above. When any sensor 12 detects a specific state for which travel control of the train 20 needs to be performed, the sensor 12 transmits, to the information acquisition unit 3 via the ground wireless apparatus 9, its own sensor ID the sensor 12 has.

Figures 22, 23:
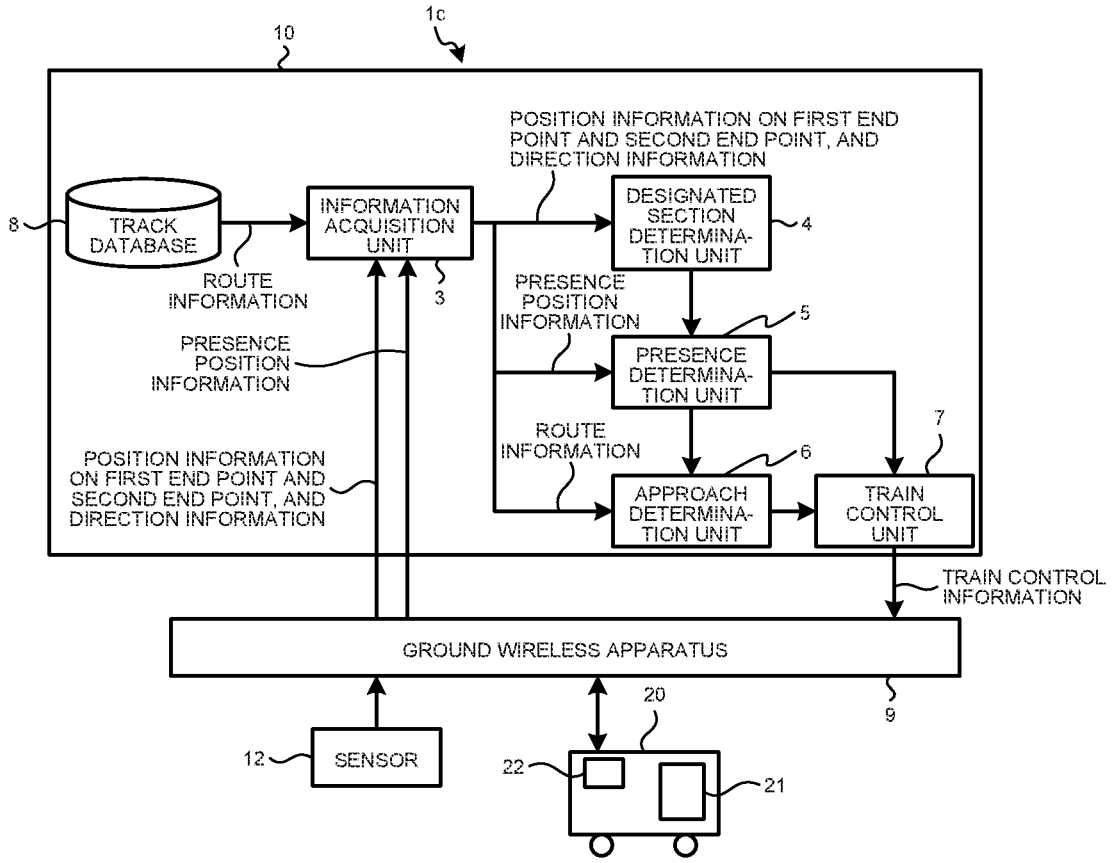
FIG. 22 is a diagram illustrating an example of a data configuration including direction information stored in the sensor information database.
FIG. 23 is a block diagram illustrating another example of the configuration of the train presence detection apparatus according to the fourth embodiment of the present invention.

FIG. 22 is a diagram illustrating an example of a data configuration including direction information stored in the sensor information database. For example, as illustrated in FIG. 22, the sensor information database 13 stores, in association with the sensor ID, the position information on the first end point P1 and the second end point P2 located at both ends of the designated section and direction information for indicating in which direction (clockwise or counterclockwise direction) from the first end point P1 to the second end point P2 the designated section that is any of the first section A1 and the second section A2 in which the first end point P1 and the second end point P2 are located at both ends is located. In the train presence detection apparatus 1*c*, when any sensor 12 detects a specific state and when the information acquisition unit 3 receives the sensor ID from the sensor 12, the information acquisition unit 3 accesses the sensor information database 13 on the basis of the received sensor ID, and acquires the position information on the first end point P1 and the second end point P2 and the direction information, where the position information and the direction information correspond to the received sensor ID. Thus, the train presence detection apparatus 1*c* can determine the designated section by the designated section determination unit 4 similarly to the train presence detection apparatus 1*b* illustrated in FIG. 16.

The train presence detection apparatus 1*c* according to the fourth embodiment of the present invention includes the sensors 12 each of which detects a state in the loop line section L1 or around the loop line section L1 and the sensor information database 13 that stores, in association with an ID each sensor 12 has, the position information on the first end point of P1 and the second end point P2 and the direction information, and when any sensor 12 detects a specific state, the information acquisition unit 3 acquires the position information on the first end point P1 and the second end point P2 and the direction information from the sensor information database 13 on the basis of the ID the sensor 12 has. Consequently, it is possible to determine the designated section efficiently in accordance with a state in the loop line section L1 or around the loop line section L1 detected by the sensor 12.

Similarly to the train presence detection apparatus 1 according to the first embodiment, the train presence detection apparatus 1*c* according to the fourth embodiment may also be configured to include the sensor information database 13 in the on-board apparatus 21 included in the train, in addition to the input reception unit 2, the information acquisition unit 3, the designated section determination unit 4, the presence determination unit 5, the approach determination unit 6, the train control unit 7, the track database 8, and the presence position calculation unit 11. In such a case, similarly to the train presence detection apparatus 1*a* illustrated in FIG. 13, for example, a configuration is employed in which when the sensor 12 detects a specific state for which travel control of the train 20 needs to be performed, the sensor 12 transmits its own sensor ID the sensor 12 has to the on-board wireless apparatus 22 via the ground wireless apparatus 9, and the on-board wireless apparatus 22 transmits the sensor ID to the information acquisition unit 3. The train presence detection apparatus 1*c* may also be configured as a train control system including the ground apparatus 10 and the on-board apparatus 21.

FIG. 23 is a block diagram illustrating another example of the configuration of the train presence detection apparatus according to the fourth embodiment of the present invention. In the train presence detection apparatus 1*c* illustrated in FIG. 23, for example, the sensor 12 has stored in advance the position information on the first end point Pl, the position information on the second end point P2, and the direction information in a storage unit (not illustrated), and is configured to transmit the position information on the first end point P1 and the second end point P2 and the direction information to the information acquisition unit 3 via the ground wireless apparatus 9 when a specific state is detected. Thus, in the train presence detection apparatus 1*c* illustrated in FIG. 23, although the ground apparatus 10 does not include the sensor information database 13, the information acquisition unit 3 can acquire the position information on the first end point P1 and the second end point P2 and the direction information.

Fifth Embodiment

Figure 24:
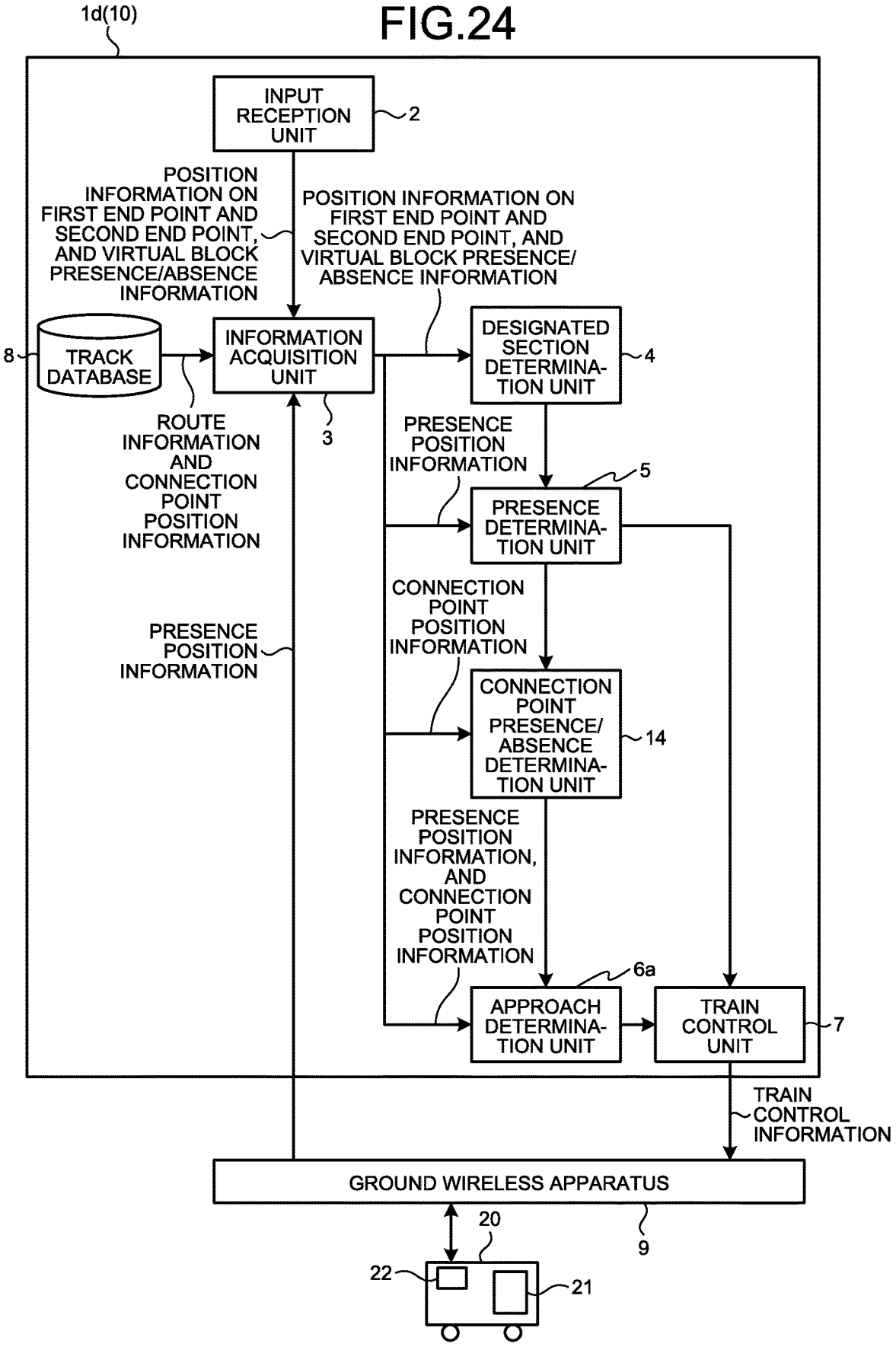
FIG. 24 is a block diagram illustrating an example of a configuration of a train presence detection apparatus according to a fifth embodiment of the present invention.
Figure 25:
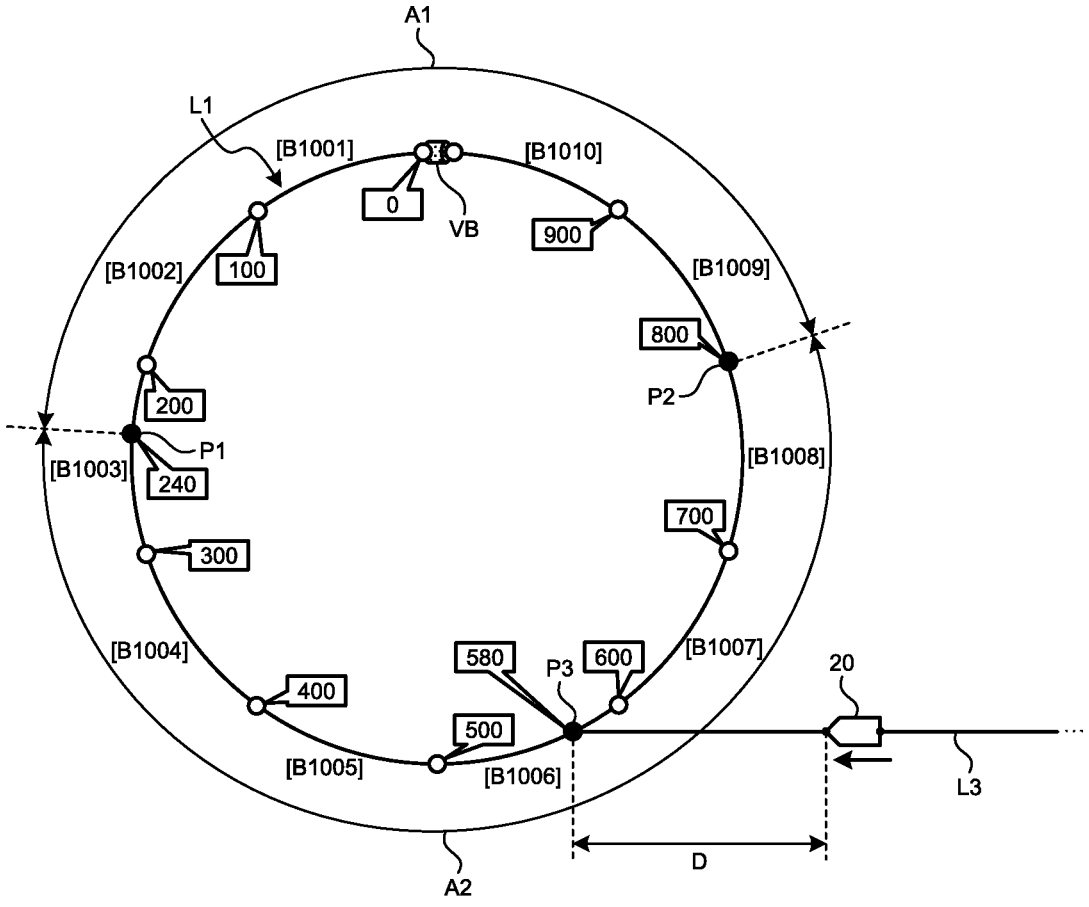
FIG. 25 is a diagram illustrating an example of a configuration in which a third line section, through which a train can enter the first line section, is connected to the first line section.

Next, a train presence detection apparatus 1*d* according to a fifth embodiment of the present invention will be described. FIG. 24 is a block diagram illustrating an example of a configuration of the train presence detection apparatus according to the fifth embodiment of the present invention. FIG. 25 is a diagram illustrating an example of a configuration in which a third line section L3, through which a train can enter the first line section L1 formed in a loop, is connected to the first line section L1. As illustrated in FIG. 24, the train presence detection apparatus 1*d* according to the fifth embodiment of the present invention further includes a connection point presence/absence determination unit 14 in addition to the configuration included in the train presence detection apparatus 1 illustrated in FIG. 1 according to the first embodiment. Regarding configurations and the like similar to those of the train presence detection apparatus 1 according to the first embodiment of the present invention, same reference numerals are given thereto, and detailed descriptions thereof will be omitted.

In the train presence detection apparatus 1*d*, the track database 8 stores connection point position information in advance, in addition to the route information. The connection point position information is information that indicates, as illustrated in FIG. 25, the position of a connection point P3 where the loop line section L1 that is a first line section formed in a loop and the third line section L3 through which a train can enter the loop line section L1 are connected. The connection point position information is expressed, for example, by a block number and an intra-block position, similarly to the position information on the first end point P1 and the second end point P2. For example, FIG. 25 illustrates an example in which the connection point position information is expressed as 580 obtained by adding 80 that is a coordinate value at the intra-block position in the block

[B1006] to 500 that is kilometrage (coordinate value) at a reference point of the block [B1006]. The third line section L3 is not particularly limited as long as a train can enter the first line section L1 therethrough, and the third line section L3 may be a line section formed in a loop.

As illustrated in FIG. 24, the information acquisition unit 3 of the train presence detection apparatus 1*d* can acquire route information and connection point position information from the track database 8. The connection point presence/absence determination unit 14 determines whether the connection point P3 is located in the designated section. For example, when the designated section determination unit 4 determines that the first section A1 that includes the virtual block VB illustrated in FIG. 25 is the designated section, the connection point presence/absence determination unit 14 uses the connection point position information to determine whether the position (kilometrage) of the connection point P3 is included in the block sequence of the designated section (first section A1) illustrated in FIG. 4, thereby determining whether the connection point P3 is located in the designated section A1. In the example of FIG. 25, when the designated section determination unit 4 determines that the first section A1 is the designated section, the connection point presence/absence determination unit 14 determines that the connection point P3 is not located in the designated section A1 because kilometrage (580) at the position of the connection point P3 is not included in the block sequence of less than or equal to the kilometrage (240) at the position of the first end point P1 of the designated section A1 illustrated in FIG. 4 or greater than or equal to the kilometrage (800) at the position of the second end point P2 thereof. Alternatively, when the designated section determination unit 4 determines that the second section A2 that does not include the virtual block VB is the designated section, the connection point presence/absence determination unit 14 determines that the connection point P3 is located in the designated section A2 because the kilometrage (580) at the position of the connection point P3 is included in the block sequence from the kilometrage (240) at the position of the first end point P1 of the designated section A2 illustrated in FIG. 5 to the kilometrage (800) at the position of the second end point P2 thereof.

An approach determination unit 6*a* determines whether the train 20 is approaching a designated section. When the connection point presence/absence determination unit 14 determines that the connection point P3 is located in the designated section, the approach determination unit 6*a* determines whether a distance D from the train 20 traveling from the third line section L3 toward the loop line section L1 to the connection point P3 is within a specific range. Even in a case where the train 20 is not traveling in the loop line section L1 but traveling in the third line section L3, when the connection point P3 to the loop line section L1 the train enters is located in the designated section that is a temporary speed limit section or a train protection section, there may be a case where it is necessary to reduce the traveling speed of the train 20 or to stop the train 20 when the train 20 approaches the designated section. Therefore, the approach determination unit 6*a* determines whether the train 20 traveling from the third line section L3 toward the loop line section L1 is approaching the designated section.

For example, as illustrated in FIG. 24, the approach determination unit 6*a* can determine whether the train 20 is approaching the designated section by using the presence position information and the connection point position information. The approach determination unit 6*a* uses, for example, the presence position information and the connection point position information to calculate the distance D from the front end position of the train 20 to the connection point P3, and determines whether the distance D falls in a specific distance range set depending on the types of the designated section and the like, thereby determining whether the train 20 is approaching the designated section. The method for determining whether the train 20 is approaching the designated section performed by the approach determination unit 6*a* is not limited to the above method. For example, the route information that indicates a route on which the train 20 travels and the connection point position information may be used to determine whether the connection point P3 is included in a route on which the train 20 travels, the route being indicated by the route information, and when the connection point P3 is included in the route on which the train 20 travels, it may be determined that the train 20 is approaching the designated section.

When it is determined by the presence determination unit 5 that the train 20 is present in the designated section or when it is determined by the approach determination unit 6*a* that the train 20 is approaching the designated section, the train control unit 7 generates train control information for performing travel control such that the traveling speed of the train 20 is reduced to a specific speed or lower or train control information for stopping the train 20, for example, depending on the types of the designated section. The train control information generated by the train control unit 7 is transmitted to the train 20 via the ground wireless apparatus 9.

Figure 26:
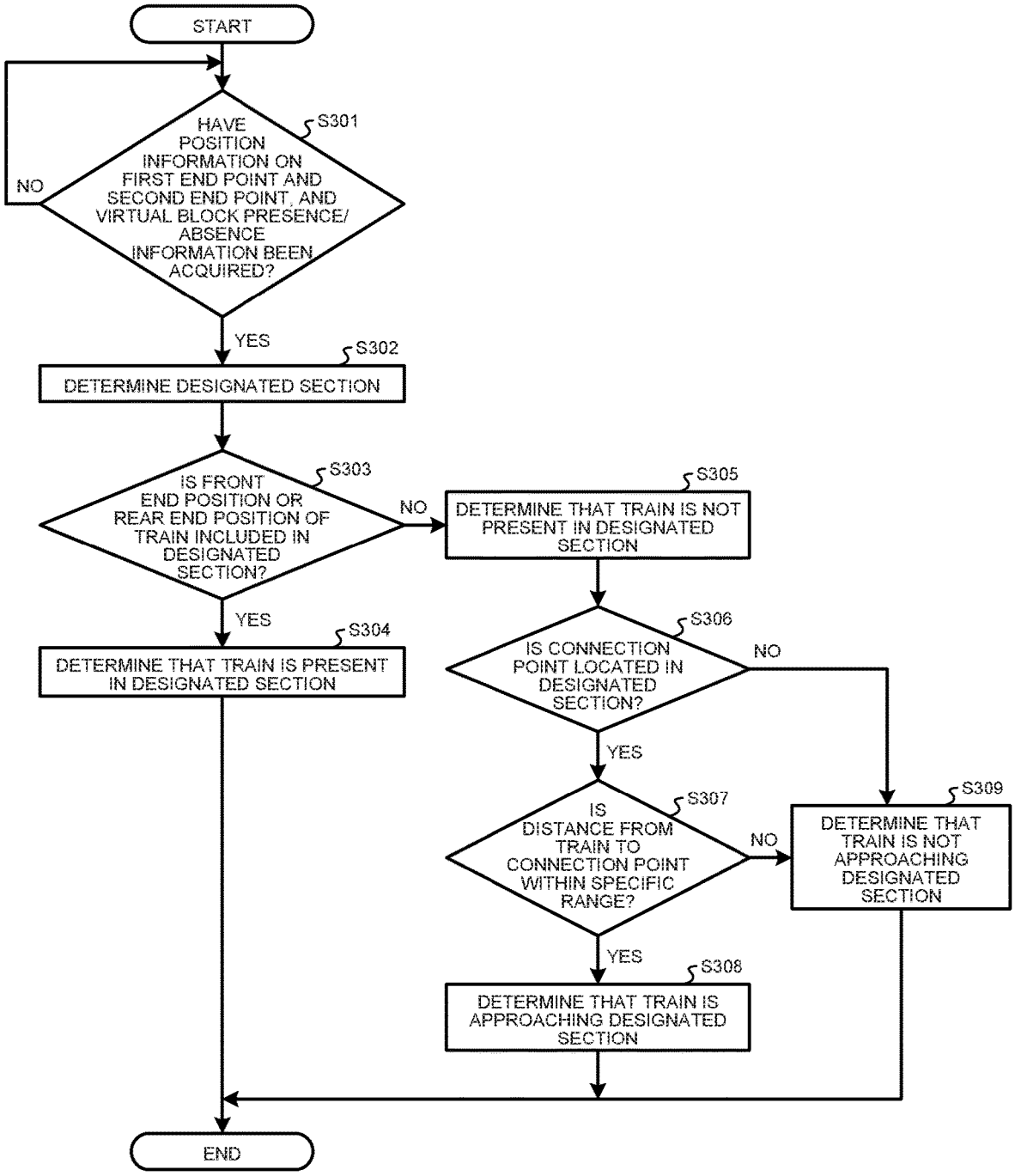
FIG. 26 is a flowchart illustrating an example of a flow of processes performed by the train presence detection apparatus according to the fifth embodiment of the present invention.

FIG. 26 is a flowchart illustrating an example of a flow of processes performed by the train presence detection apparatus 1*d* according to the fifth embodiment of the present invention. Hereinafter, the flow of processes performed by the train presence detection apparatus 1*d* will be described with reference to the flowchart of FIG. 26. In the train presence detection apparatus 1*d* according to the present embodiment, as illustrated in FIG. 26, the information acquisition unit 3 first determines whether the position information on the first end point P1 and the second end point P2 and the virtual block presence/absence information, which are input information received by the input reception unit 2, have been acquired (S301). When the information acquisition unit 3 determines that the position information on the first end point P1 and the second end point P2 and the virtual block presence/absence information have not been acquired (S301: No), the information acquisition unit 3 again determines whether the position information on the first end point P1 and the second end point P2 and the virtual block presence/absence information have been acquired (S301). That is, the information acquisition unit 3 repeats the determination of S301 until the position information on the first end point P1 and the second end point P2 and the virtual block presence/absence information are acquired. When the information acquisition unit 3 determines that the position information on the first end point P1 and the second end point P2 and the virtual block presence/absence information have been acquired (S301: Yes), the information acquisition unit 3 outputs the position information on the first end point P1 and the second end point P2 and the virtual block presence/absence information thus acquired to the designated section determination unit 4.

On the basis of the position information on the first end point P1 and the second end point P2 and the virtual block presence/absence information received from the information acquisition unit 3, the designated section determination unit 4 determines which of the first section A1 and the second section A2 in which the first end point P1 and the second end point P2 are located at both ends is the designated section, and generates a block sequence indicating the section (designated section) between two points that are the first end point P1 and the second end point P2 (S302).

The presence determination unit 5 determines whether the front end position or the rear end position of the train 20 is included in the block sequence of the designated section on the basis of the presence position information on the train 20 acquired by the information acquisition unit 3 and the information on the designated section determined by the designated section determination unit 4 (S303). When the presence determination unit 5 determines that the kilometrage at the front end position or the rear end position of the train 20 is included in the designated section (S303: Yes), for example, the presence determination unit 5 determines that the train 20 is present in the designated section (S304), and ends the presence detection process performed by the train presence detection apparatus 1*d*.

When the presence determination unit 5 determines that neither the kilometrage at the front end position of the train 20 nor that at the rear end position thereof is included in the designated section (S303: No), the presence determination unit 5 determines that the train 20 is not present in the designated section (S305).

When the presence determination unit 5 determines that the train 20 is not present in the designated section, next, the connection point presence/absence determination unit 14 determines whether the connection point P3 is located in the designated section (S306). When the connection point presence/absence determination unit 14 determines that the connection point P3 is located in the designated section (S306: Yes), the approach determination unit 6*a* determines whether the distance D from the train 20 traveling from the third line section L3 toward the loop line section L1 to the connection point P3 is within a specific range (S307).

When the approach determination unit 6*a* determines that the distance D from the train 20 to the connection point P3 is within the specific range (S307: Yes), the approach determination unit 6*a* determines that the train 20 is approaching the designated section (S308), and ends the presence detection process performed by the train presence detection apparatus 1*d*.

On the other hand, when the approach determination unit 6*a* determines that the distance D from the train 20 to the connection point P3 is not within the specific range (S307: No), the approach determination unit 6*a* determines that the train 20 is not approaching the designated section (S309), and ends the presence detection process performed by the train presence detection apparatus 1*d*. When the connection point presence/absence determination unit 14 determines that the connection point P3 is not located in the designated section (S306: No), the approach determination unit 6*a* determines that the train 20 is not approaching the designated section (S309), and ends the presence detection process performed by the train presence detection apparatus 1*d*.

In the flowchart illustrated in FIG. 26, the example is illustrated in which the presence determination unit 5 determines that the train 20 is not present in the designated section (S305), and then the connection point presence/absence determination unit 14 determines whether the connection point P3 is located in the designated section (S306). However, in the train presence detection apparatus 1*d*, after the process of S305, the approach determination unit 6*a* may determine whether the starting end point that is an end point of the designated section closer to the train 20 in a traveling direction of the train 20 is included in a route on which the train 20 travels, the route being indicated by the route information, similarly to the process of S106 illustrated in the flowchart of FIG. 8, and when the approach determination unit 6*a* determines that the starting end point of the designated section is not included in the route on which the train 20 travels and which is indicated by the route information, the processes after the process of S306 may be executed.

The train presence detection apparatus 1*d* according to the fifth embodiment of the present invention includes the connection point presence/absence determination unit 14 that, when the presence determination unit 5 determines that the train 20 is not present in the designated section, determines whether the connection point P3 where the loop line section L1 and the third line section L3 are connected is located in the designated section; and the approach determination unit 6*a* that, when the connection point presence/absence determination unit 14 determines that the connection point P3 is located in the designated section, determines whether the distance D from the train 20 traveling from the third line section L3 toward the loop line section L1 to the connection point P3 is within a specific range. Consequently, even in a case where the train 20 is not traveling in the loop line section L1 but traveling in the third line section L3, when the connection point P3 to the loop line section L1 the train enters is located in the designated section, it is possible to determine whether the train 20 is approaching the designated section.

In the present embodiment, the description of the train presence detection apparatus 1*d* is given by taking the example in which the train presence detection apparatus 1*d* is configured from the ground apparatus 10 that performs wireless communication with the train 20 via the ground wireless apparatus 9, but there is no limitation thereto. The on-board apparatus 21 included in the train 20 may be configured as the train presence detection apparatus 1*d*, similarly to the train presence detection apparatus 1 illustrated in FIG. 10. The train presence detection apparatus 1*d* may be configured as a train control system including the ground apparatus 10 and the on-board apparatus 21. When the train presence detection apparatus 1*d* is configured as the train control system including the ground apparatus 10 and the on-board apparatus 21, a configuration may be employed in which, for example, the ground apparatus 10 has functions of the input reception unit 2, the information acquisition unit 3, and the designated section determination unit 4, and the on-board apparatus 21 has functions of the presence determination unit 5, the approach determination unit 6*a*, the train control unit 7, the track database 8, and the presence position calculation unit 11.

Regarding the train presence detection apparatus 1*d*, the example is indicated in which the input reception unit 2 receives the input of the position information on the first end point P1 and the second end point P2 and the virtual block presence/absence information. However, similarly to the train presence detection apparatus 1*a* according to the second embodiment, the train presence detection apparatus 1*d* may include, instead of the input reception unit 2, the sensor 12 that detects a state in the loop line section L or around the loop line section L, and the sensor information database 13. Alternatively, similarly to the train presence detection apparatus 1*a* illustrated in FIG. 14, a configuration may be employed in which the sensor 12 stores the position information on the first end point Pl, the position information on the second end point P2, and the virtual block presence/absence information in advance, and the position information on the first end point P1 and the second end point P2 and the virtual block presence/absence information are transmitted to the information acquisition unit 3 via the ground wireless apparatus 9 when a specific state is detected.

The present invention is not limited to the above embodiments, and each embodiment can be appropriately modified or omitted without departing from the scope of the concept of the present invention.

REFERENCE SIGNS LIST

1 to 1*d* train presence detection apparatus; 2 input reception unit; 3 information acquisition unit; 4 designated section determination unit; 5 presence determination unit; 6 approach determination unit; 10 ground apparatus; 12 sensor; 13 sensor information database; 14 connection point presence/absence determination unit; 20 train; 21 on-board apparatus; A1 first section; A2 second section; L1 first line section; L2 second line section; L3 third line section; P1 first end point; P2 second end point; P3 connection point.

The invention claimed is:

1. A train presence detection apparatus comprising:

an information obtainer to acquire position information on a first end point and a second end point located in a first line section formed in a loop and virtual block presence/absence information indicative of whether a virtual block indicating a specific position in the first line section is included in a designated section that is any of a first section and a second section in which the first end point and the second end point are located at both ends;

a designated section determiner to determine which of the first section and the second section is the designated section on a basis of the position information on the first end point and the second end point and the virtual block presence/absence information acquired by the information obtainer; and a presence determiner to determine whether a train is present in the designated section determined by the designated section determiner.

2. The train presence detection apparatus according to claim 1, comprising:

an input receiver to receive input of the position information on the first end point and the second end point and the virtual block presence/absence information, wherein the information obtainer acquires the position information on the first end point and the second end point and the virtual block presence/absence information received by the input receiver.

3. The train presence detection apparatus according to claim 2, wherein the input receiver is provided in a ground apparatus that performs wireless communication with the train or an on-board apparatus mounted on the train.

4. The train presence detection apparatus according to claim 1, comprising:

a sensor to detect a state in the first line section or around the first line section; and a sensor information database to store the position information on the first end point and the second end point and the virtual block presence/absence information in association with an ID the sensor has, wherein when the sensor detects a specific state, the information obtainer acquires the position information on the first end point and the second end point and the virtual block presence/absence information from the sensor information database on a basis of the ID the sensor has.

5. The train presence detection apparatus according to claim 4, wherein the sensor is any of a wind speed sensor, a rock fall detection sensor, a seismic sensor, a liquid level sensor, and a weather sensor.

6. The train presence detection apparatus according to claim 1, comprising:

a sensor to detect a state in the first line section or around the first line section, wherein when the sensor detects a specific state, the sensor transmits the position information on the first end point and the second end point and the virtual block presence/absence information, and the information obtainer acquires the position information on the first end point and the second end point and the virtual block presence/absence information.

7. The train presence detection apparatus according to claim 6, wherein the sensor is any of a wind speed sensor, a rock fall detection sensor, a seismic sensor, a liquid level sensor, and a weather sensor.

8. The train presence detection apparatus according to claim 1, comprising an approach determiner to, when the presence determiner determines that the train is not present in the designated section, determine whether a distance from the train to a starting end point is within a specific range, the starting end point being any of the first end point and the second end point that is closer to the train in a traveling direction of the train.

9. The train presence detection apparatus according to claim 1, wherein the first line section is connected adjacent to a second line section that is formed in a loop and is different from the first line section, and the virtual block is provided at a connection point where the first line section and the second line section are connected.

10. The train presence detection apparatus according to claim 1, wherein the first line section is connected to a third line section through which the train is allowed to enter the first line section, and the train presence detection apparatus comprises:

a connection point presence/absence determiner to, when the presence determiner determines that the train is not present in the designated section, determine whether a connection point where the first line section and the third line section are connected is located in the designated section; and an approach determiner to, when the connection point presence/absence determiner determines that the connection point is located in the designated section, determine whether a distance from the train traveling from the third line section toward the first line section to the connection point is within a specific range.

11. A train presence detection apparatus comprising:

an information obtainer to acquire position information on a first end point and a second end point located in a first line section formed in a loop and direction information for indicating in which direction from the first end point to the second end point a designated section that is any of a first section and a second section in which the first end point and the second end point are located at both ends is located;

a designated section determiner to determine which of the first section and the second section is the designated section on a basis of the position information on the first end point and the second end point and the direction information acquired by the information obtainer; and a presence determiner to determine whether a train is present in the designated section determined by the designated section determiner.

12. The train presence detection apparatus according to claim 11, comprising:

an input receiver to receive input of the position information on the first end point and the second end point and the direction information, wherein the information obtainer acquires the position information on the first end point and the second end point and the direction information received by the input receiver.

13. The train presence detection apparatus according to claim 12, wherein the input receiver is provided in a ground apparatus that performs wireless communication with the train or an on-board apparatus mounted on the train.

14. The train presence detection apparatus according to claim 11, comprising:

a sensor to detect a state in the first line section or around the first line section; and a sensor information database to store the position information on the first end point and the second end point and the direction information in association with an ID the sensor has, wherein when the sensor detects a specific state, the information obtainer acquires the position information on the first end point and the second end point and the direction information from the sensor information database on a basis of the ID the sensor has.

15. The train presence detection apparatus according to claim 14, wherein the sensor is any of a wind speed sensor, a rock fall detection sensor, a seismic sensor, a liquid level sensor, and a weather sensor.

16. The train presence detection apparatus according to claim 11, comprising:

a sensor to detect a state in the first line section or around the first line section, wherein when the sensor detects a specific state, the sensor transmits the position information on the first end point and the second end point and the direction information, and the information obtainer acquires the position information on the first end point and the second end point and the direction information.

17. The train presence detection apparatus according to claim 16, wherein the sensor is any of a wind speed sensor, a rock fall detection sensor, a seismic sensor, a liquid level sensor, and a weather sensor.

18. The train presence detection apparatus according to claim 11, comprising an approach determiner to, when the presence determiner determines that the train is not present in the designated section, determine whether a distance from the train to a starting end point is within a specific range, the starting end point being any of the first end point and the second end point that is closer to the train in a traveling direction of the train.

19. The train presence detection apparatus according to claim 11, wherein the first line section is connected to a third line section through which the train is allowed to enter the first line section, and the train presence detection apparatus comprises:

a connection point presence/absence determiner to, when the presence determiner determines that the train is not present in the designated section, determine whether a connection point where the first line section and the third line section are connected is located in the designated section; and an approach determiner to, when the connection point presence/absence determiner determines that the connection point is located in the designated section, determine whether a distance from the train traveling from the third line section toward the first line section to the connection point is within a specific range.

* * * * *